US011364448B2

(12) United States Patent
Cheung

(10) Patent No.: US 11,364,448 B2
(45) Date of Patent: Jun. 21, 2022

(54) MIX AND MATCH TOY KIT

(71) Applicant: HUNTAR COMPANY, Union City, CA (US)

(72) Inventor: Jason Cheung, Union City, CA (US)

(73) Assignee: Huntar Company, Union City, CA (US)

( * ) Notice: Subject to any disclaimer, the term of this patent is extended or adjusted under 35 U.S.C. 154(b) by 0 days.

(21) Appl. No.: 16/873,578

(22) Filed: May 11, 2020

(65) Prior Publication Data

US 2020/0276507 A1 Sep. 3, 2020

Related U.S. Application Data

(63) Continuation-in-part of application No. 14/121,800, filed on Oct. 20, 2014, now Pat. No. 10,646,787.

(51) Int. Cl.

| | |
|---|---|
| ***A63H 33/00*** | (2006.01) |
| ***A63H 17/00*** | (2006.01) |
| ***A63H 33/26*** | (2006.01) |
| ***A63H 27/00*** | (2006.01) |
| ***A63H 33/04*** | (2006.01) |
| ***A63H 23/00*** | (2006.01) |

(52) U.S. Cl.

CPC ..... *A63H 33/003* (2013.01); *A63H 17/002* (2013.01); *A63H 23/005* (2013.01); *A63H 27/001* (2013.01); *A63H 33/046* (2013.01); *A63H 33/26* (2013.01)

(58) Field of Classification Search

CPC .... A63H 33/046; A63H 33/044; A63H 33/06; A63H 17/002; A63H 33/10; A63H 33/003; A63H 23/005; A63H 27/001; A63H 33/26

See application file for complete search history.

(56) References Cited

U.S. PATENT DOCUMENTS

| | | | | | |
|---|---|---|---|---|---|
| 2,645,878 | A | * | 7/1953 | Johnson | A63H 17/264 446/137 |
| 2,791,867 | A | * | 5/1957 | Dasher | A63H 27/00 446/95 |
| 2,825,181 | A | * | 3/1958 | Lynella | A63H 27/004 446/137 |
| 3,640,491 | A | * | 2/1972 | Harrison | B64C 1/00 244/117 R |
| 3,791,662 | A | * | 2/1974 | Glass | A63H 17/002 280/827 |
| 3,827,181 | A | * | 8/1974 | Mabuchi | A63H 27/02 446/57 |
| 4,132,028 | A | * | 1/1979 | Ogawa | A63F 9/02 446/219 |
| 4,144,669 | A | * | 3/1979 | Ogawa | A63H 23/005 446/153 |

(Continued)

*Primary Examiner* — Melba Bumgarner
*Assistant Examiner* — Amir A Klayman
(74) *Attorney, Agent, or Firm* — Jonathan G. Grant; Grant Patent Services

(57) ABSTRACT

A mix or match toy set is disclosed wherein an airplane toy can be converted into several differently shaped units. The units are held together by using magnets in male and female connectors. The unit has interchangeable cockpit fuselage sections, jet, propeller, and fuel tank magnetic attachments and interchangeable airplane tails.

4 Claims, 39 Drawing Sheets

(56) References Cited

U.S. PATENT DOCUMENTS 4,183,173 A * 1/1980 Ogawa ..... A63H 33/003 446/279
4,193,597 A * 3/1980 Ogawa ..... A63H 17/002 273/405
4,214,402 A * 7/1980 Ogawa ..... A63H 17/002 446/90
4,591,114 A * 5/1986 Block ..... H01R 35/00 244/1 R
4,631,040 A * 12/1986 Shiraishi ..... A63H 17/002 446/124
5,078,641 A * 1/1992 Chen ..... A63H 17/002 446/145
5,409,420 A * 4/1995 Setteducati ..... A63H 15/00 446/129
6,065,720 A * 5/2000 Ash ..... B64C 1/00 244/118.2
6,623,326 B2 * 9/2003 Judkins ..... A63H 5/00 446/130
8,128,451 B2 * 3/2012 Frontera Castaner ..... A63H 27/001 446/34
9,101,849 B2 * 8/2015 Bedolla ..... A63H 27/001
9,308,462 B1 * 4/2016 Huang ..... A63H 27/02
D827,040 S * 8/2018 Effler ..... D21/447
2003/0057325 A1 * 3/2003 Carroll ..... B64C 39/024 244/120
2004/0198143 A1 * 10/2004 Grzesek ..... A63H 17/26 446/129
2006/0091258 A1 * 5/2006 Chiu ..... B64C 1/30 244/119
2008/0217470 A1 * 9/2008 Zhao ..... A63H 27/02 244/99.3
2013/0109267 A1 * 5/2013 Schweikardt ..... A63H 33/04 446/85
2015/0004869 A1 * 1/2015 Kim ..... A63H 33/08 446/92
2015/0104994 A1 * 4/2015 Rotbard ..... A63H 33/042 446/124
2015/0151209 A1 * 6/2015 Vanderbeek ..... A63H 27/001 446/61
2015/0190725 A1 * 7/2015 Berglund ..... A63F 9/12 446/92
2016/0288008 A1 * 10/2016 Wong ..... A63H 33/046
2017/0152014 A1 * 6/2017 Gould ..... B64C 39/024
2017/0216737 A1 * 8/2017 Kiribuchi ..... A63H 33/046
2018/0057136 A1 * 3/2018 Haley ..... A63H 27/001
2019/0282913 A1 * 9/2019 Lawber ..... A63H 3/46

* cited by examiner

MIX AND MATCH TOY KIT

This application is a continuation-in-part of U.S. application Ser. No. 14/121,800, filed Oct. 20, 2014, incorporated herein in its entirety.

This disclosure teaches a mix or match toy wherein there are several different units composed of a plurality of sections, all having a common theme.

BRIEF DESCRIPTION OF THE DRAWINGS

The features and advantages of the present disclosure will be more apparent from the following detailed description in conjunction with the accompanying drawings, in which.

The figures depict various embodiments of the described toy and are for purposes of illustration only. One skilled in the art will readily recognize from the following discussion that alternative embodiments of the methods and kits illustrated herein may be employed without departing from the principles of the methods and kits described herein.

DETAILED DESCRIPTION OF THE DISCLOSURE

Figure 1:
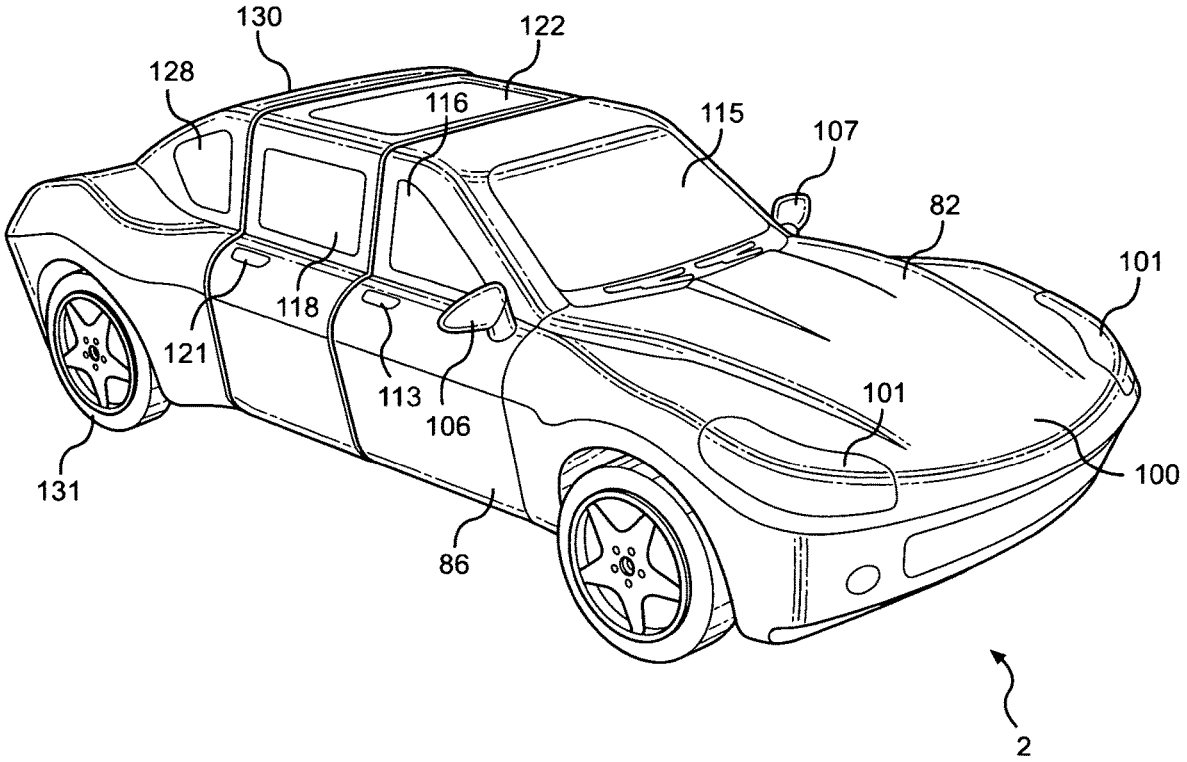
FIG. 1 is a perspective view of the automobile unit.
Figure 2:
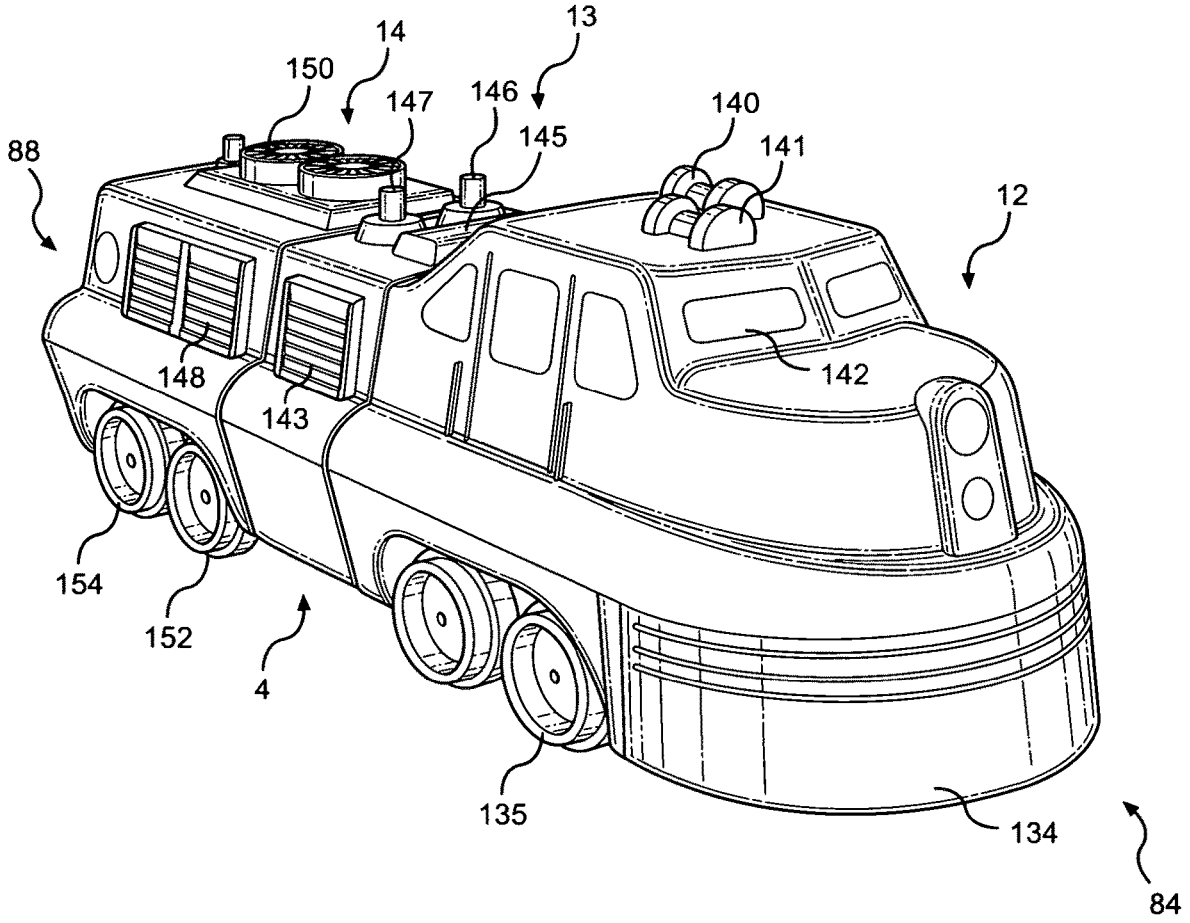
FIG. 2 is a perspective view of the locomotive unit.
Figure 3:
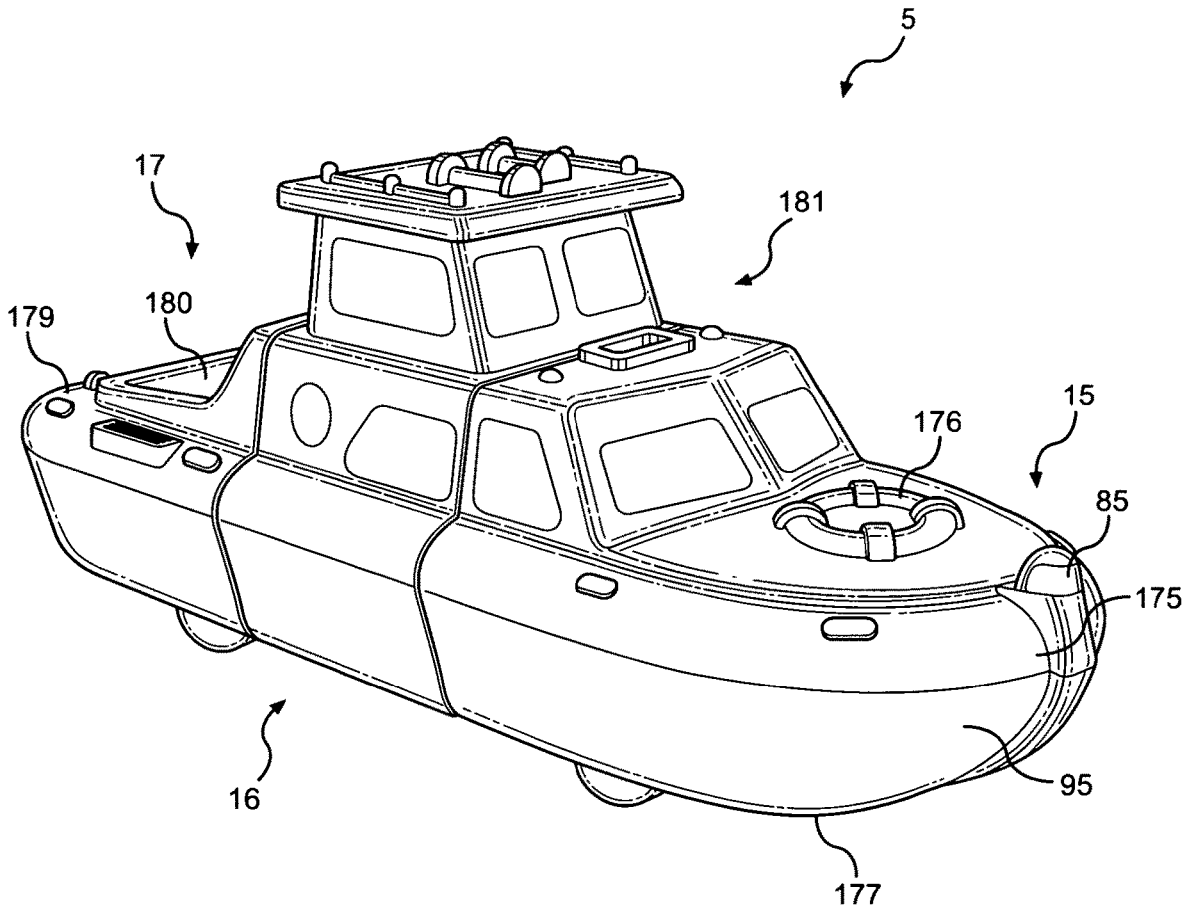
FIG. 3 is a perspective view of the boat unit
Figure 4:
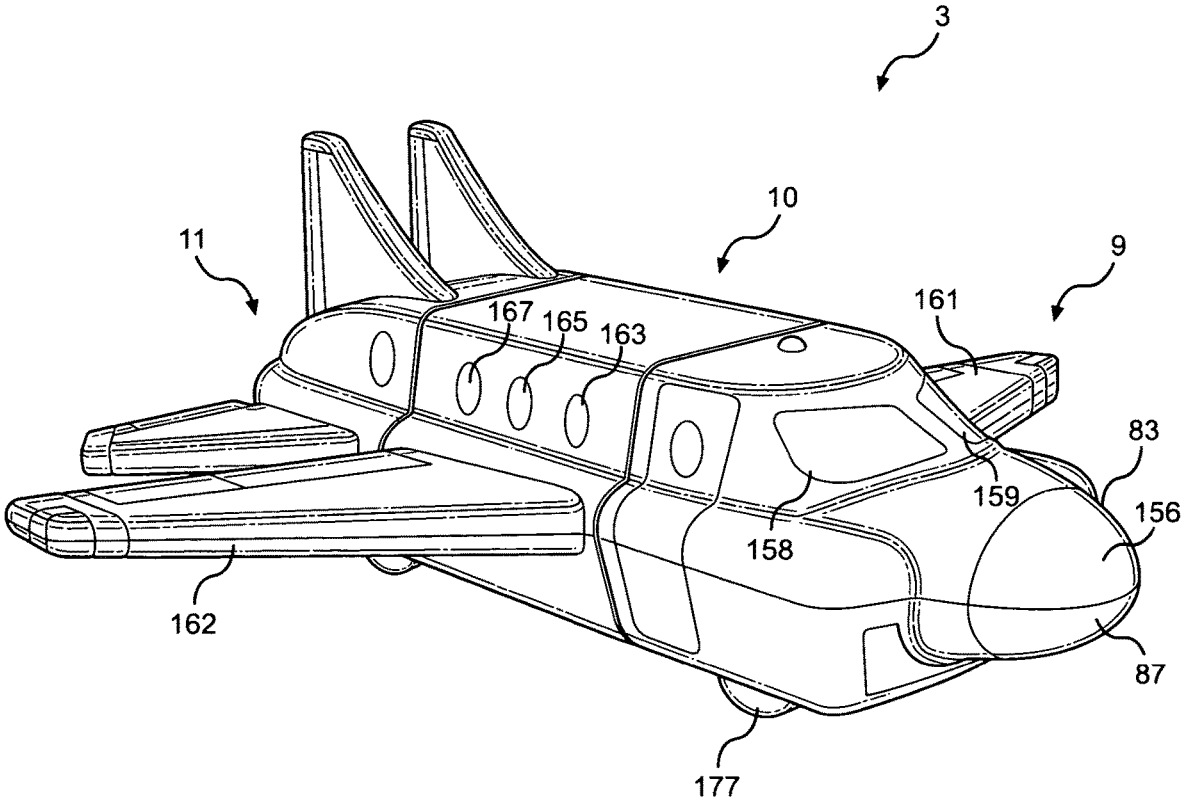
FIG. 4 is a perspective view of the airplane unit.
Figure 5:
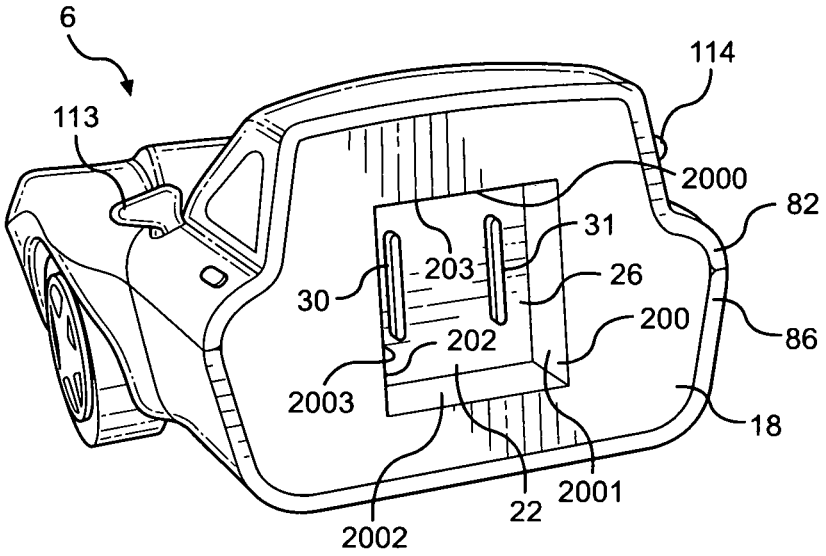
FIG. 5 is a perspective view of the distal end of the front section of automobile unit.
Figure 6:
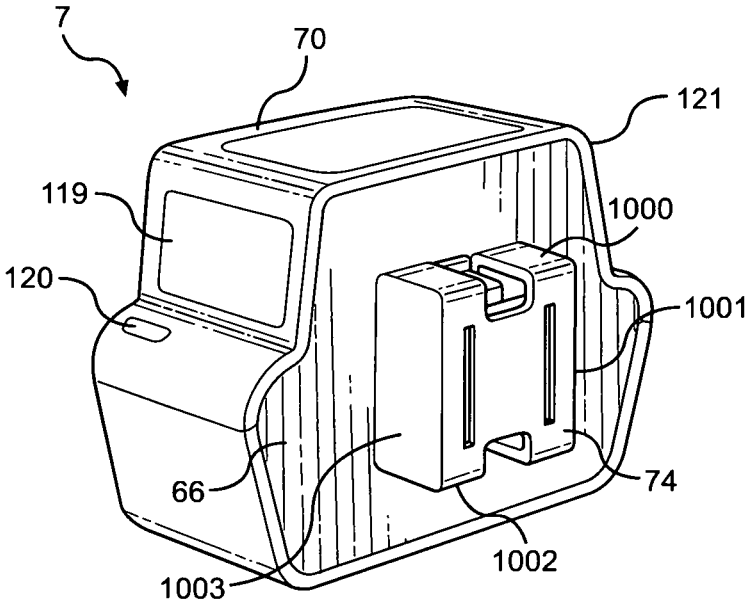
FIG. 6 is a perspective view of the proximal end of the middle section of the automobile unit.
Figure 7:
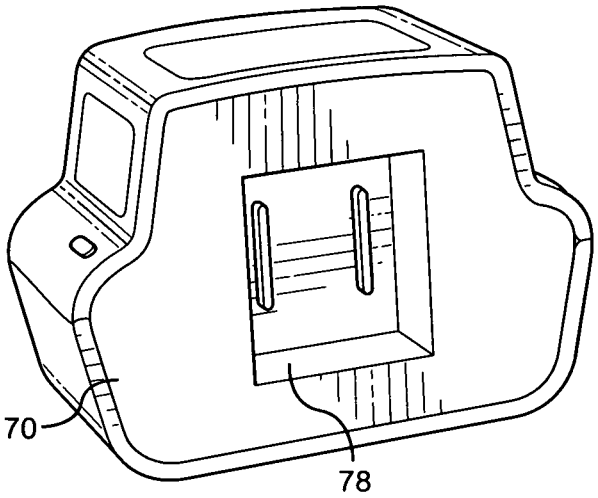
FIG. 7 is a perspective view of the distal end of the middle section of the automobile unit.
Figure 8:
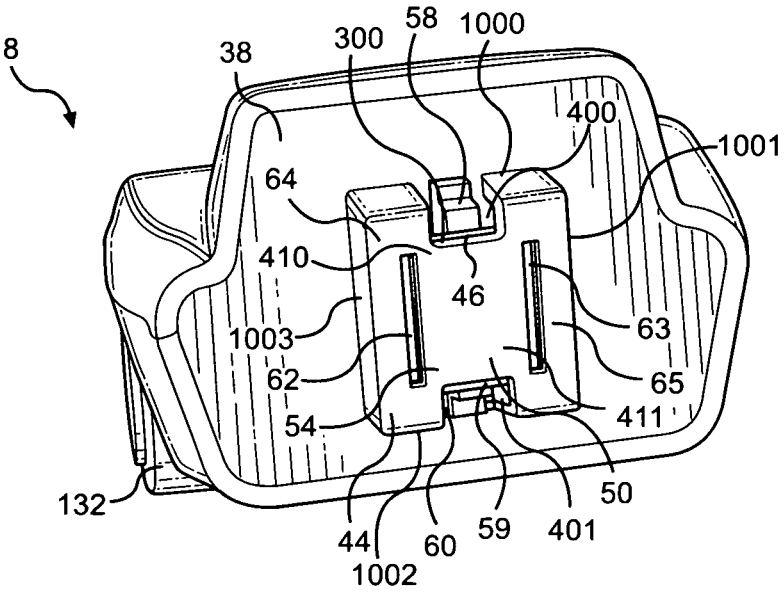
FIG. 8 is a perspective view of the proximal end of the rear section of the automobile unit.
Figure 9:
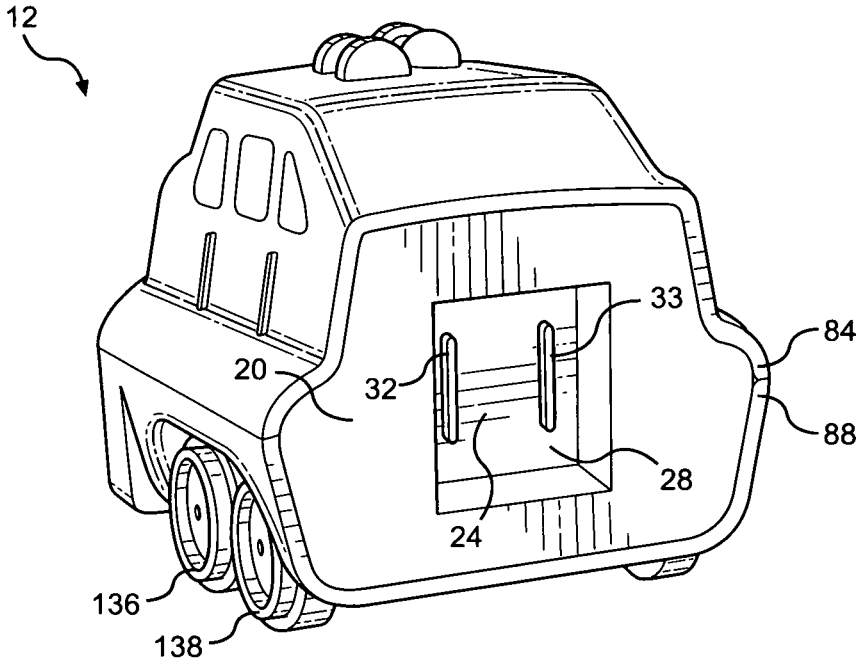
FIG. 9 is a perspective view of the distal end of the front section of the locomotive unit.
Figure 10:
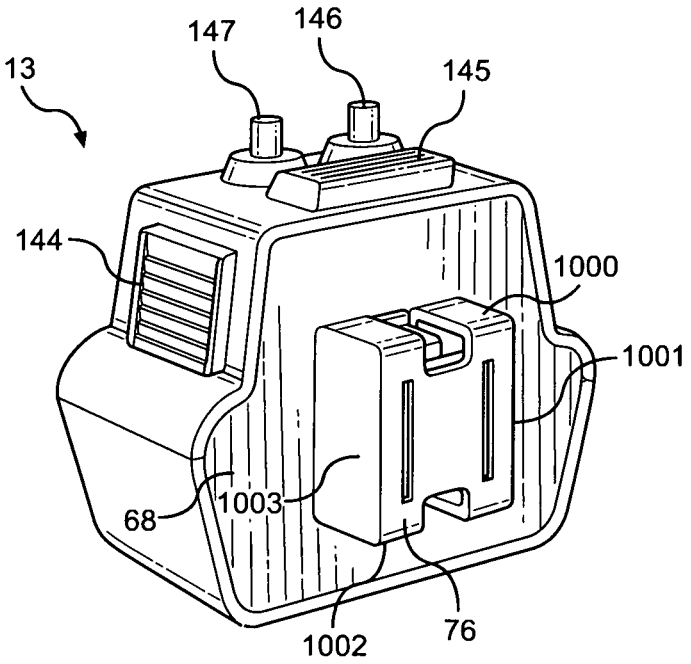
FIG. 10 is a perspective view of the proximal end of the middle section of the locomotive unit.
Figure 11:
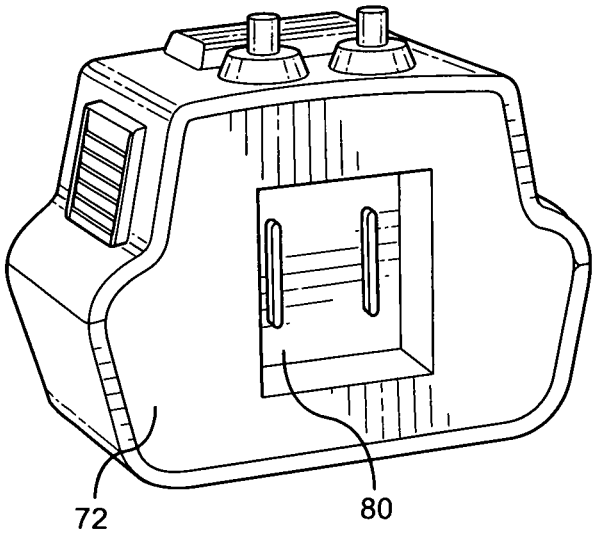
FIG. 11 is a perspective view of the distal end of the middle section of the locomotive unit.
Figure 12:
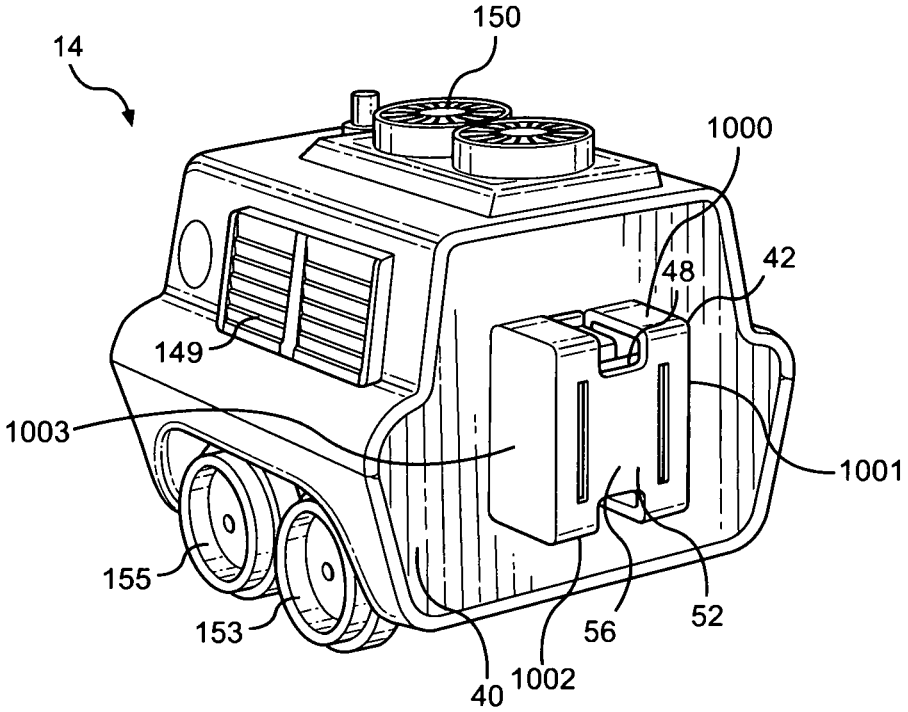
FIG. 12 is a perspective view of the proximal end of the end section of the locomotive unit.
Figure 13:
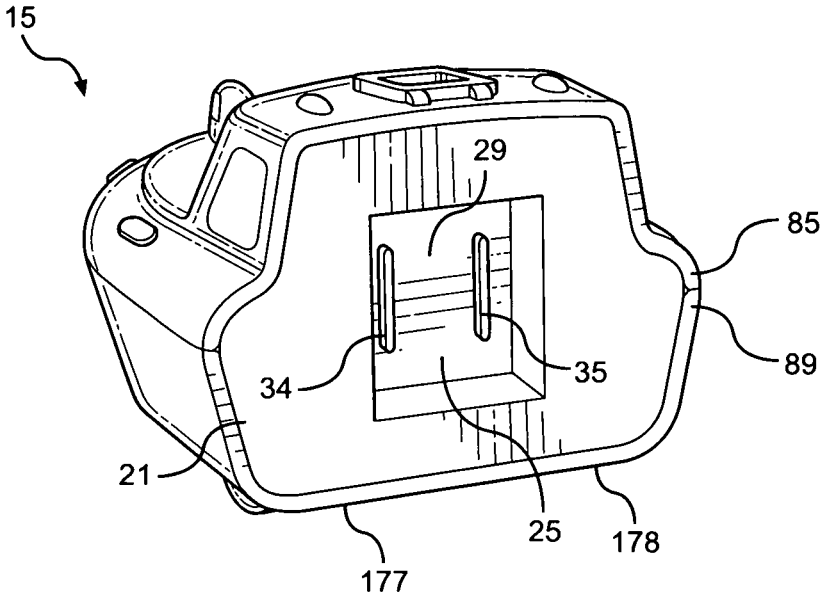
FIG. 13 is a perspective view of the distal end of the front section of the boat unit.
Figure 14:
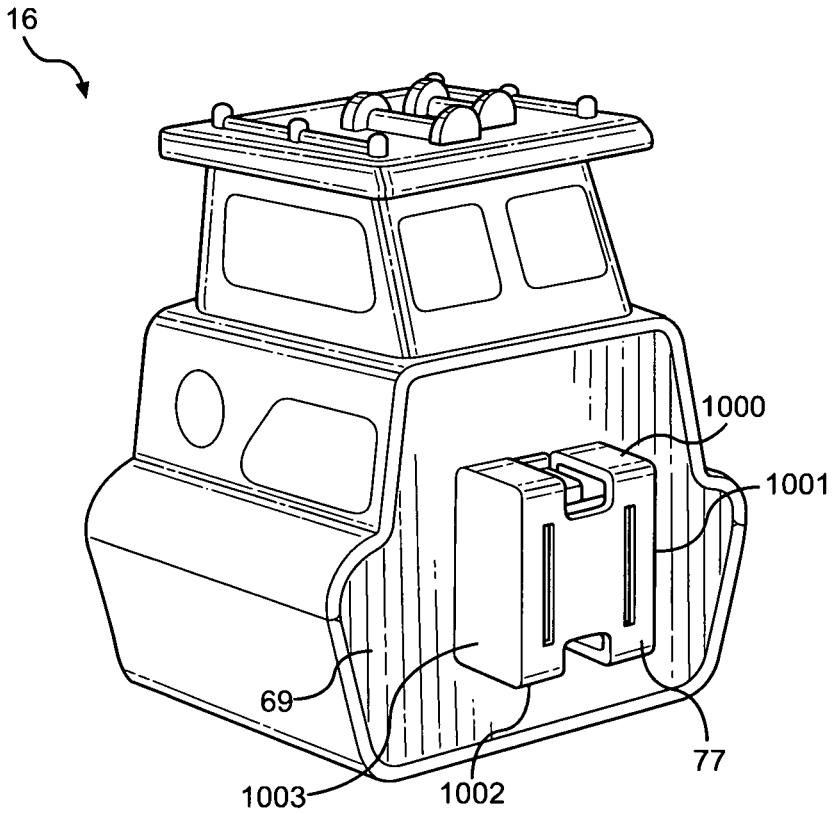
FIG. 14 is a perspective view of the proximal end of the middle section of the boat unit
Figure 15:
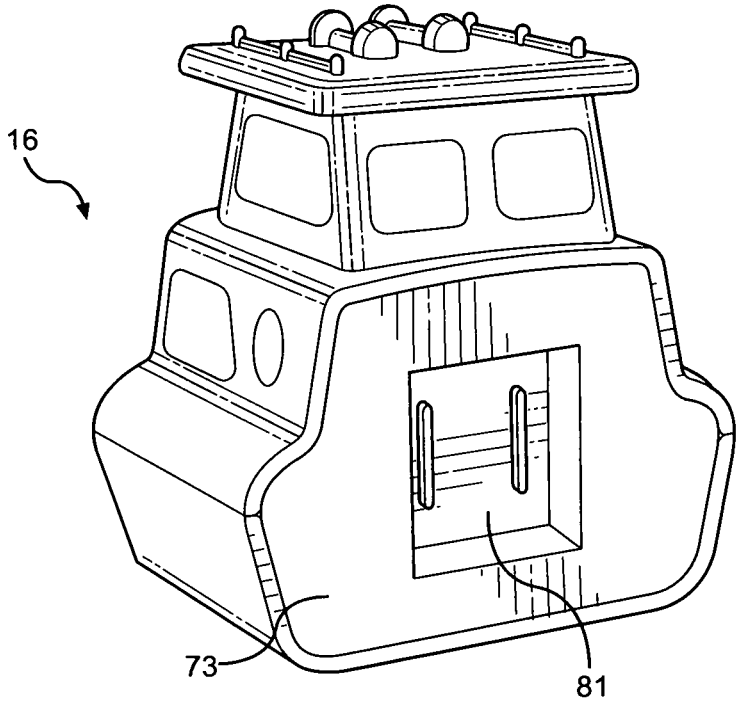
FIG. 15 is a perspective view of the distal end of the middle section of the boat unit
Figure 16:
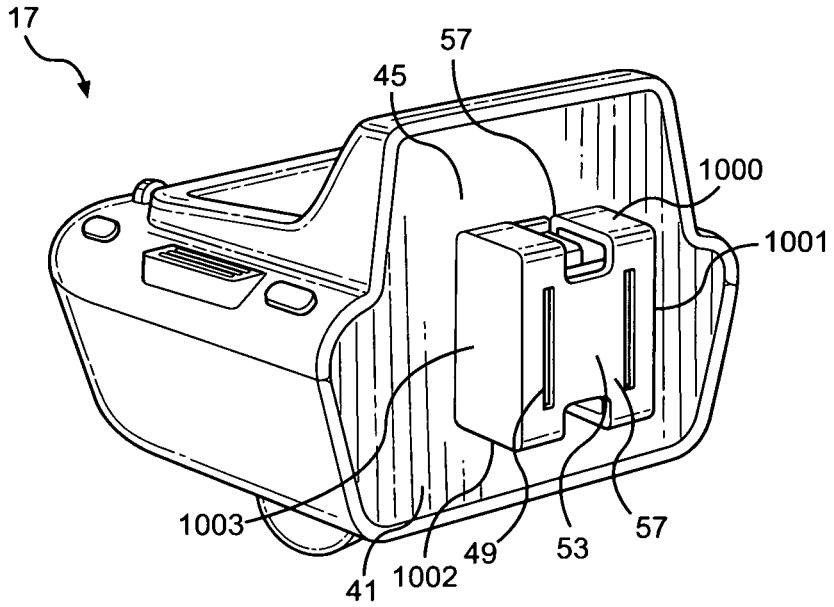
FIG. 16 is a perspective view of the proximal end of the of the end section of the boat unit.
Figure 17:
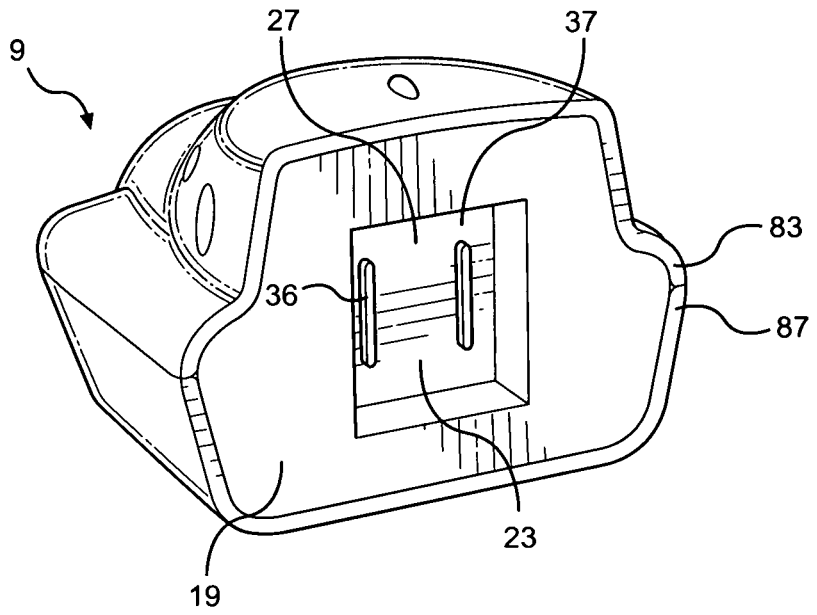
FIG. 17 is a perspective view of the distal end of the front section of the airplane unit.
Figure 18:
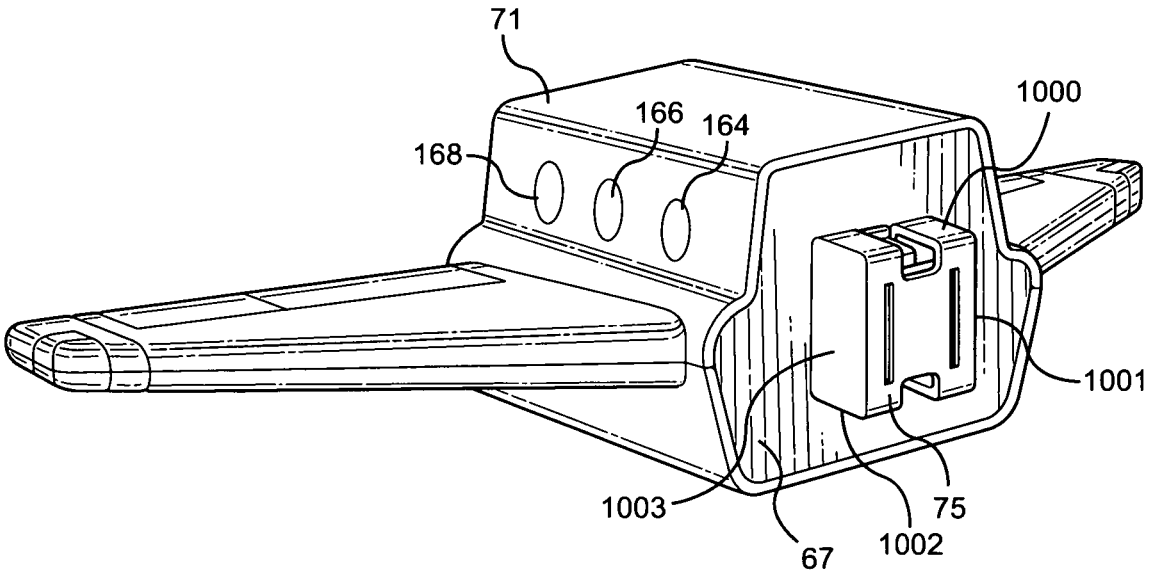
FIG. 18 is a perspective view of the proximal end of the middle section of the airplane unit.
Figure 19:
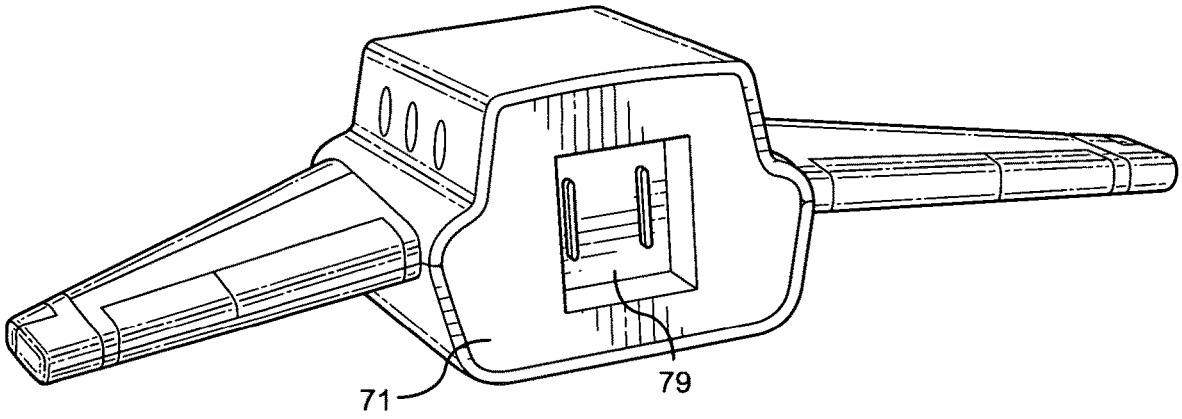
FIG. 19 is a perspective view of the distal end of the middle section of the airplane unit.
Figure 20:
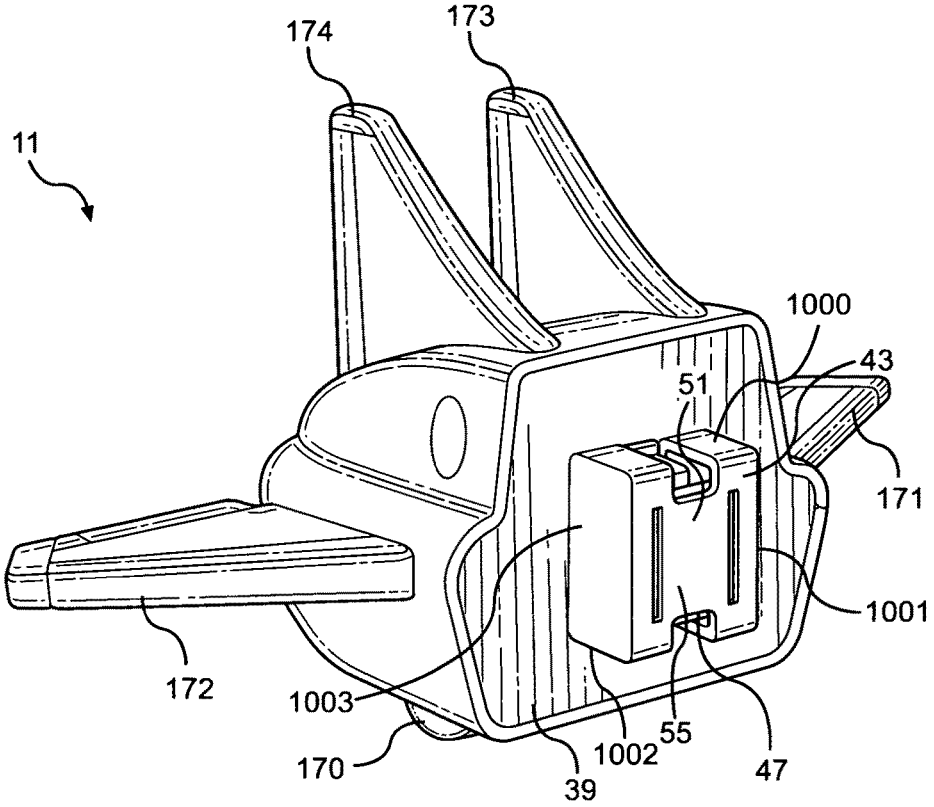
FIG. 20 is a perspective view of the proximal end of the end section of the airplane unit.
Figure 21:
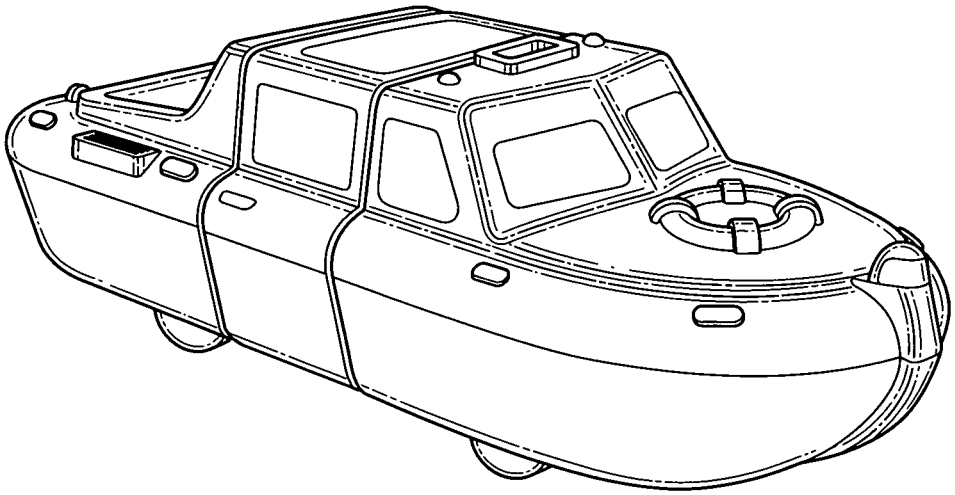
FIG. 21 is a perspective view of an interchanged mid-section vehicle assembly.
Figure 22:
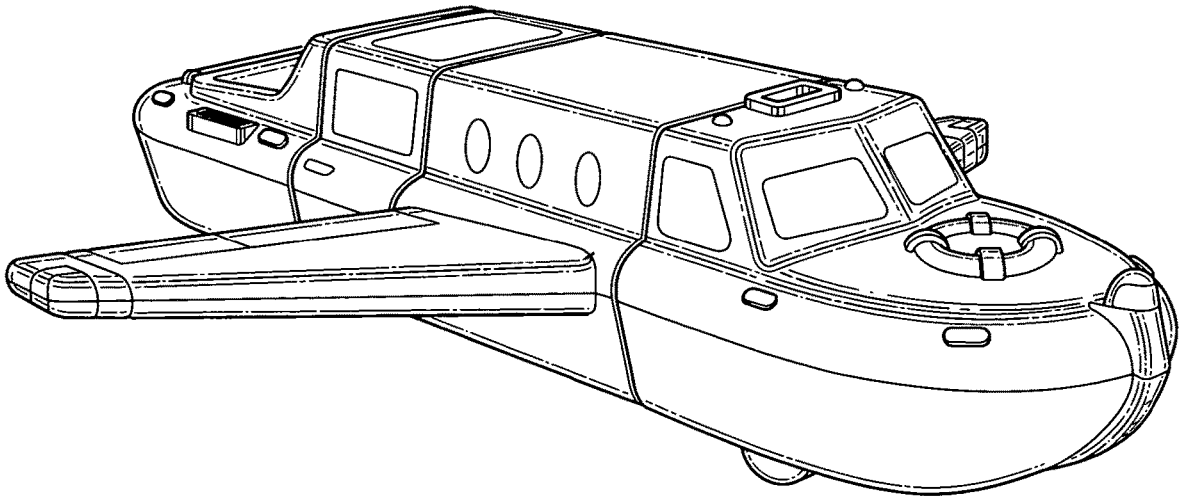
FIG. 22 is a perspective view of an additional interchanged mid-section for a vehicle.
Figure 23:
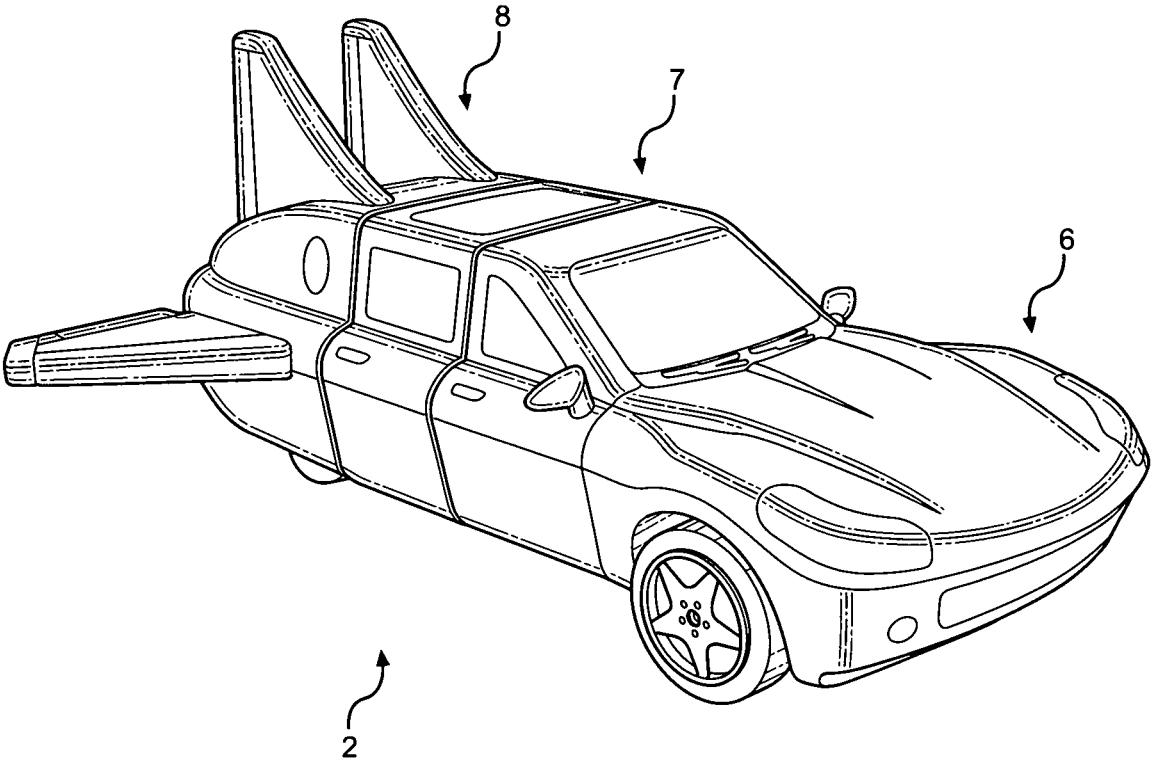
FIG. 23 is a perspective view of an interchanged end section.
Figure 24:
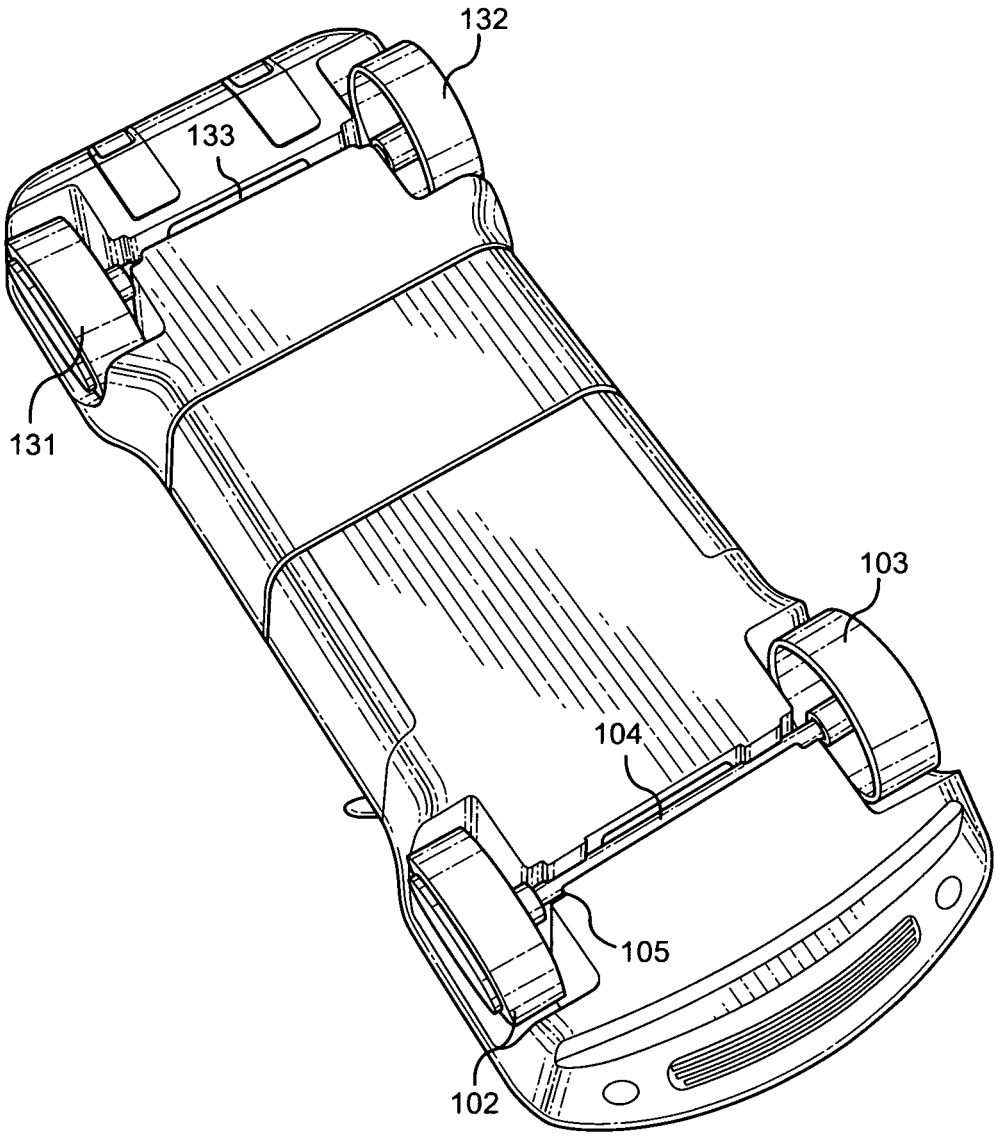
FIG. 24 is a perspective view of the underside of the automobile unit.
Figure 25:
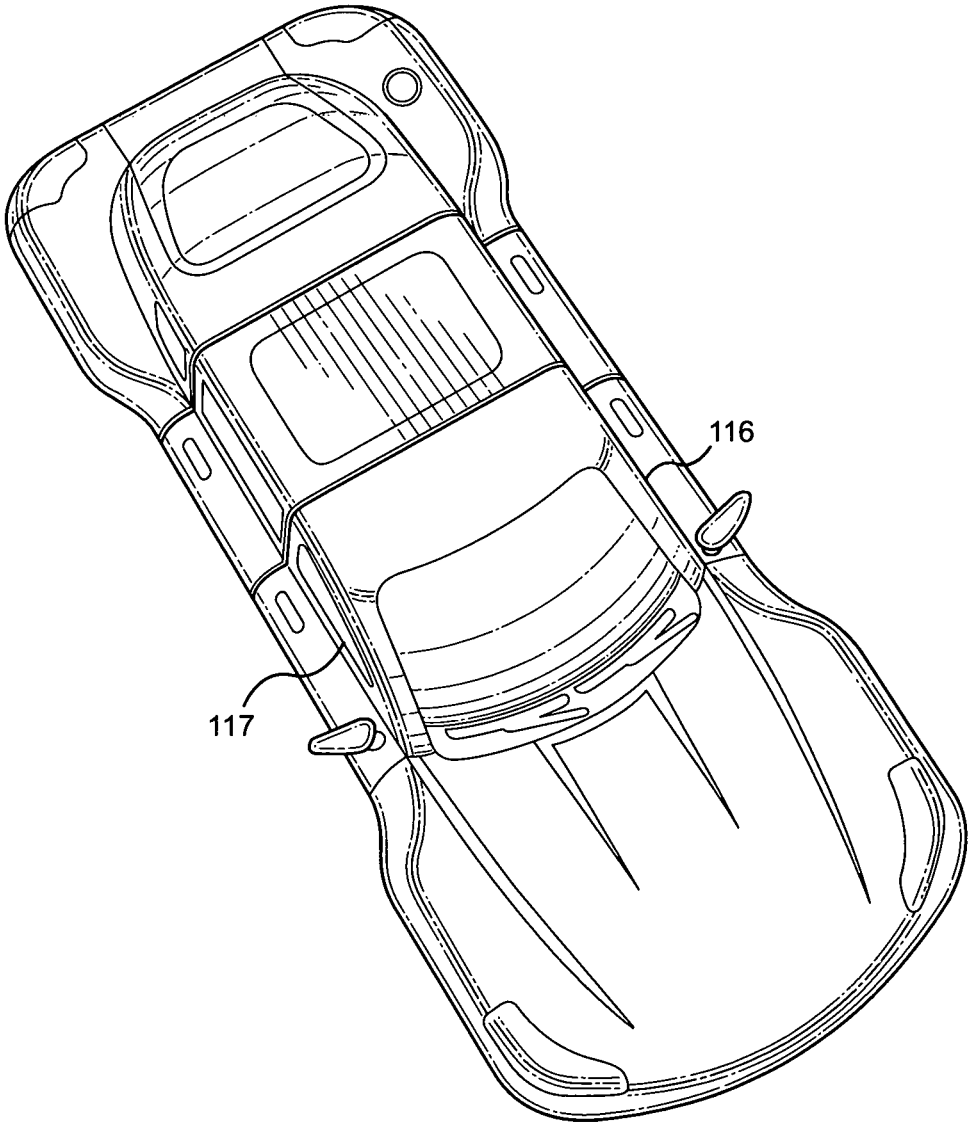
FIG. 25 is a perspective view of the top side of the automobile unit.
Figure 26:
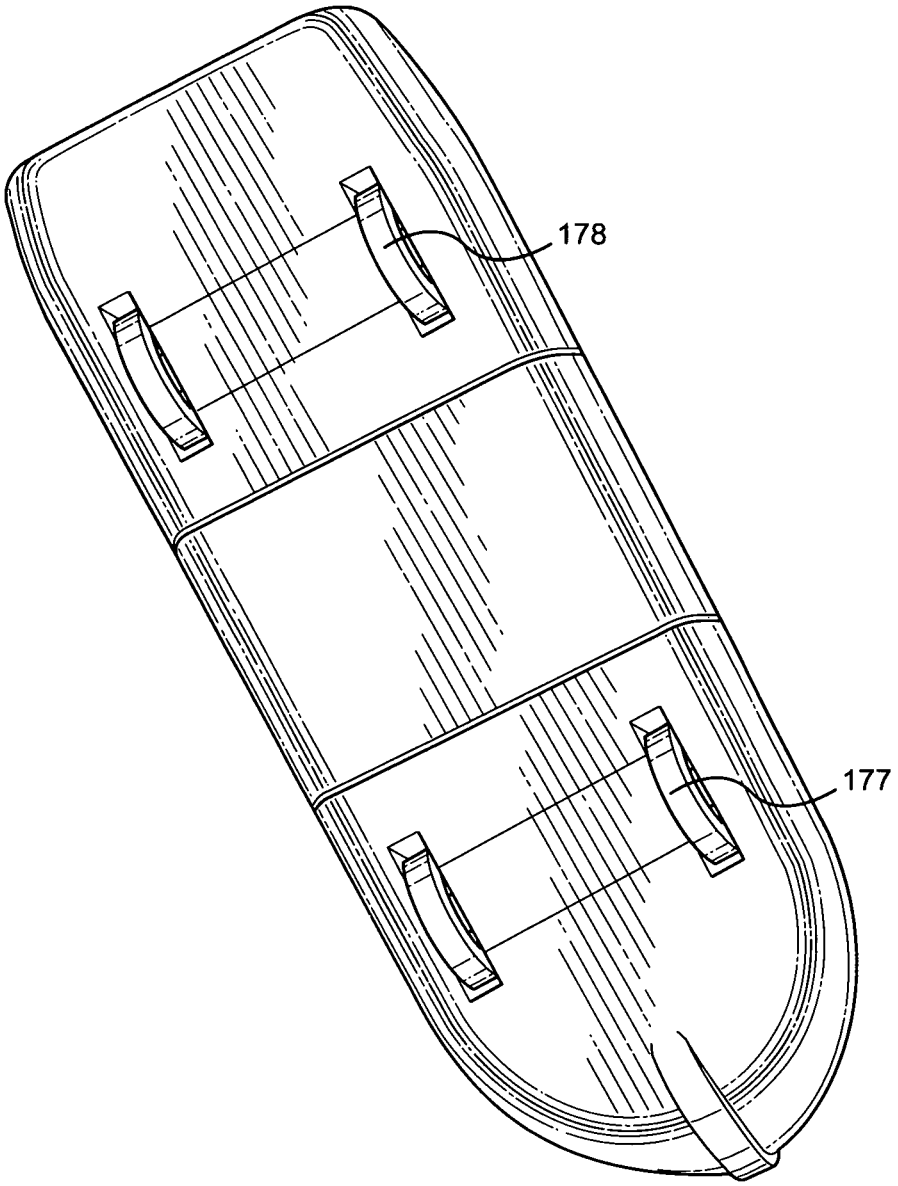
FIG. 26 is a perspective view of the underside of the boat unit.
Figure 27:
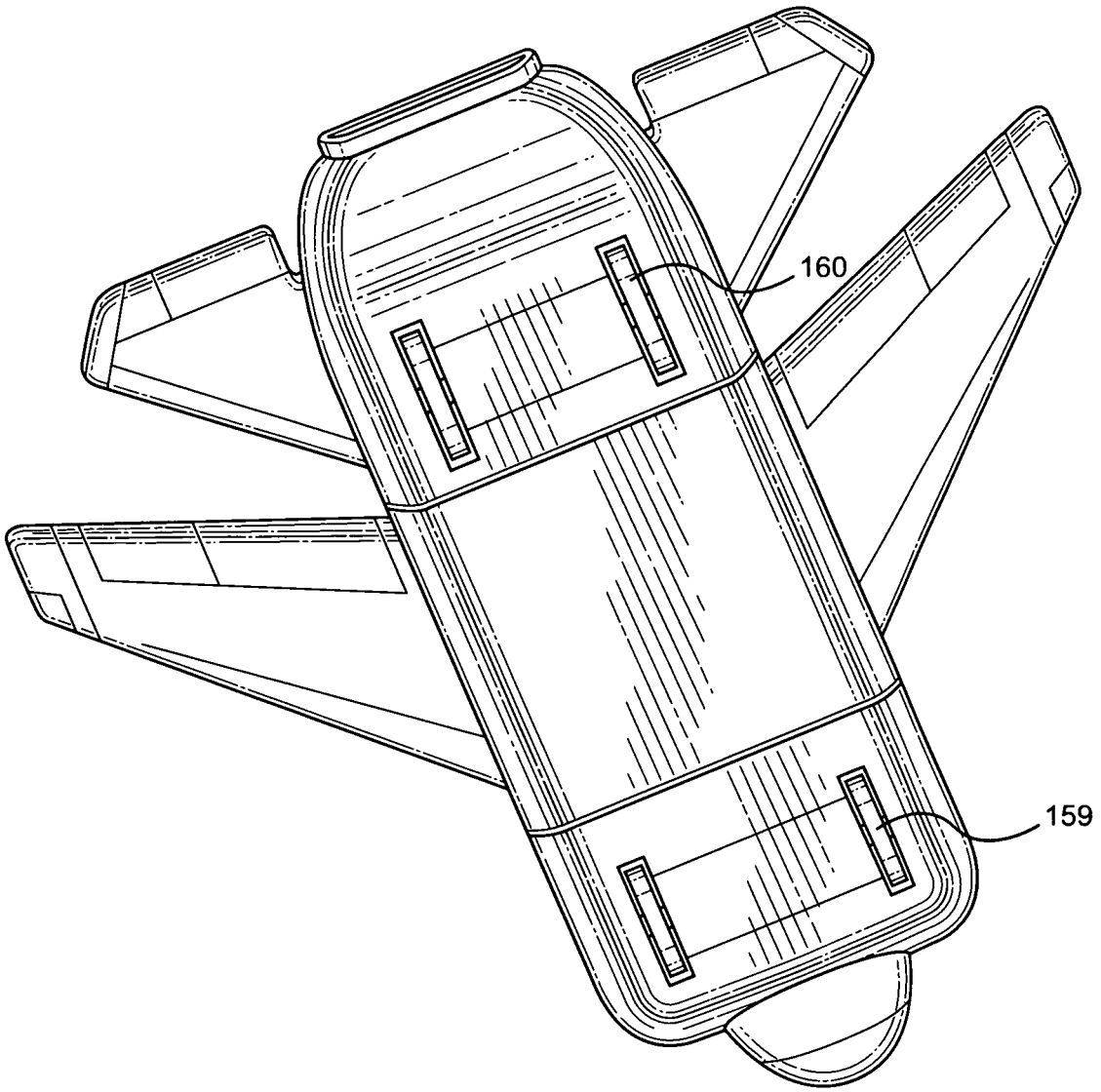
FIG. 27 is a perspective view of the underside of the airplane unit.
Figure 28:
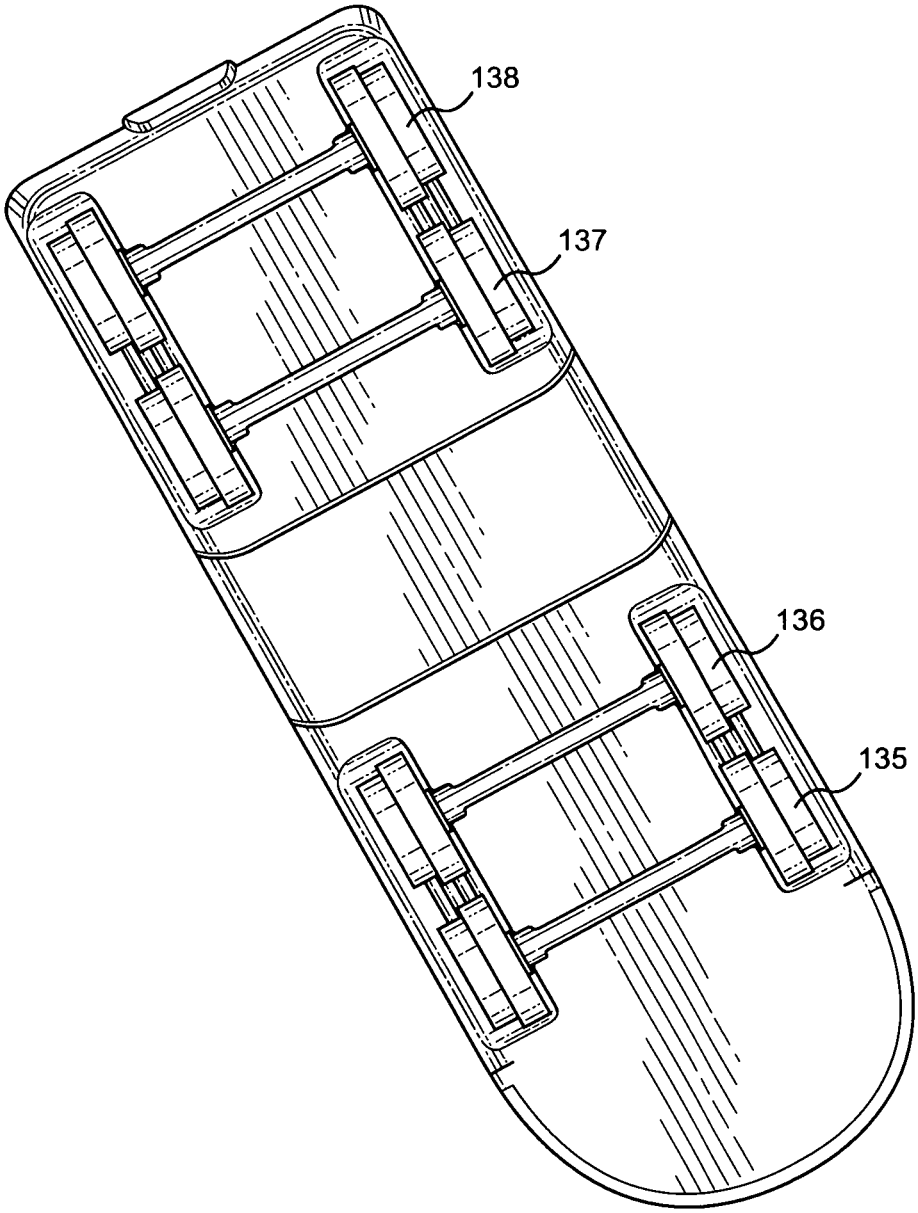
FIG. 28 is a perspective view of the underside of the locomotive unit.
Figure 29:
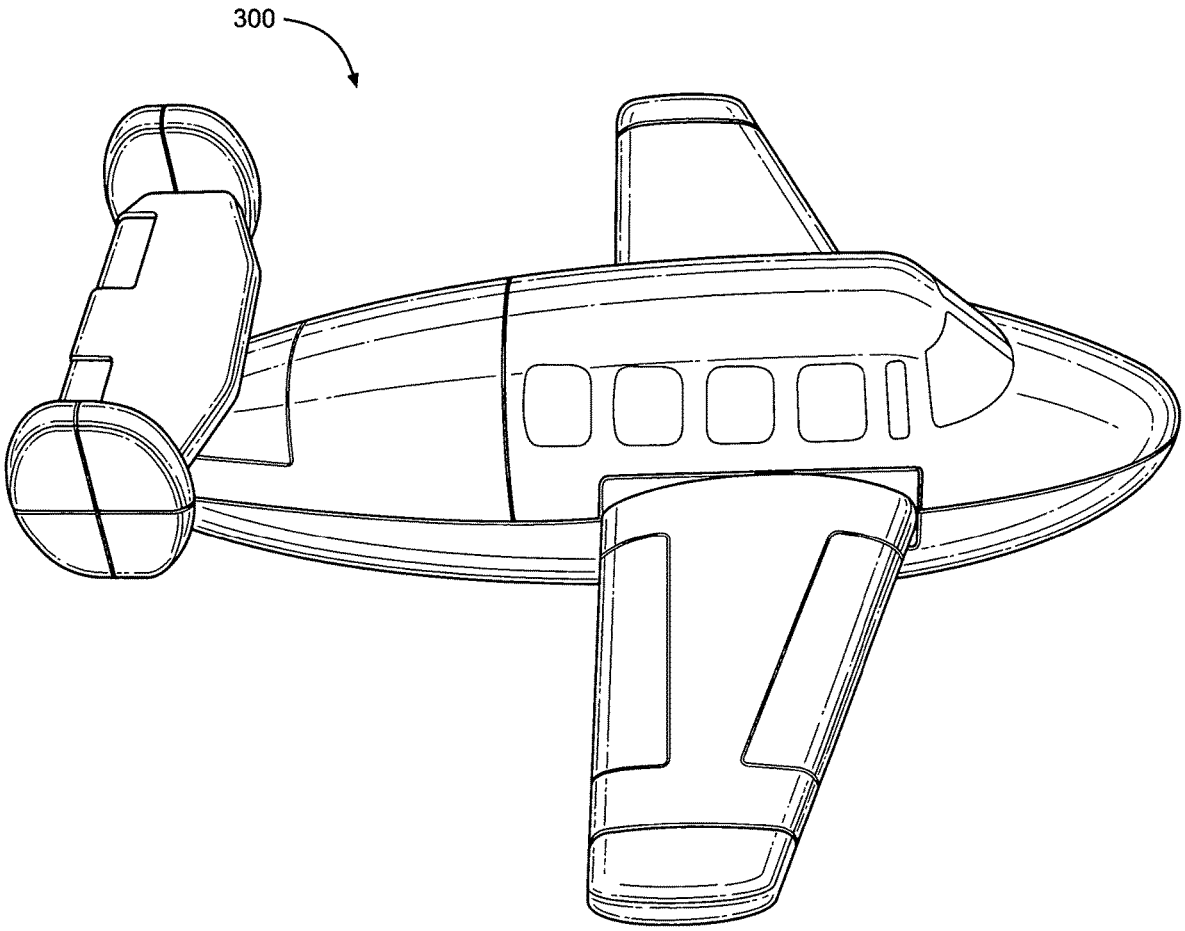
FIG. 29 is a perspective view of an airplane model.
Figure 30:
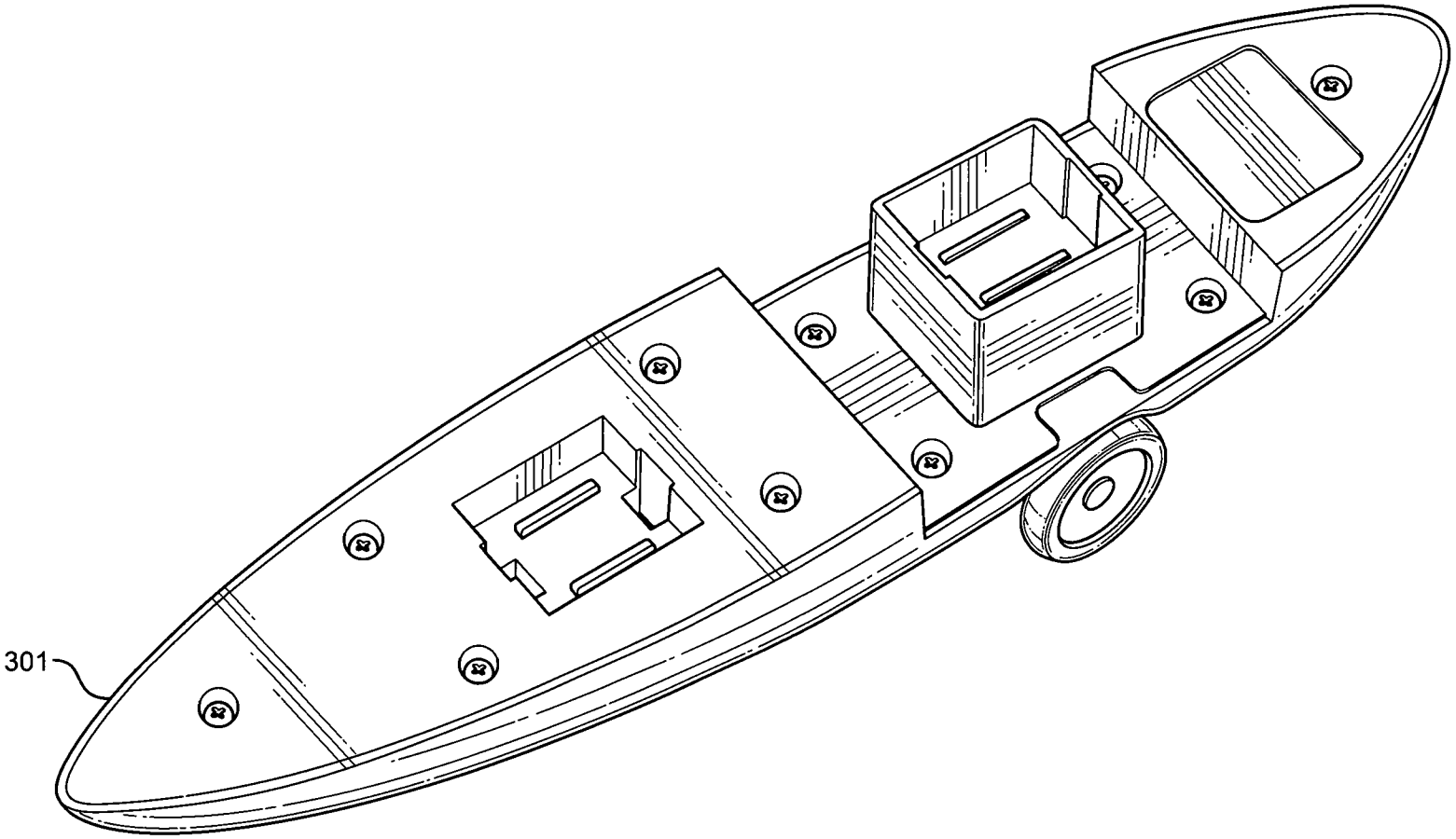
FIG. 30 is a an overhead view of the fuselage base.
Figure 31:
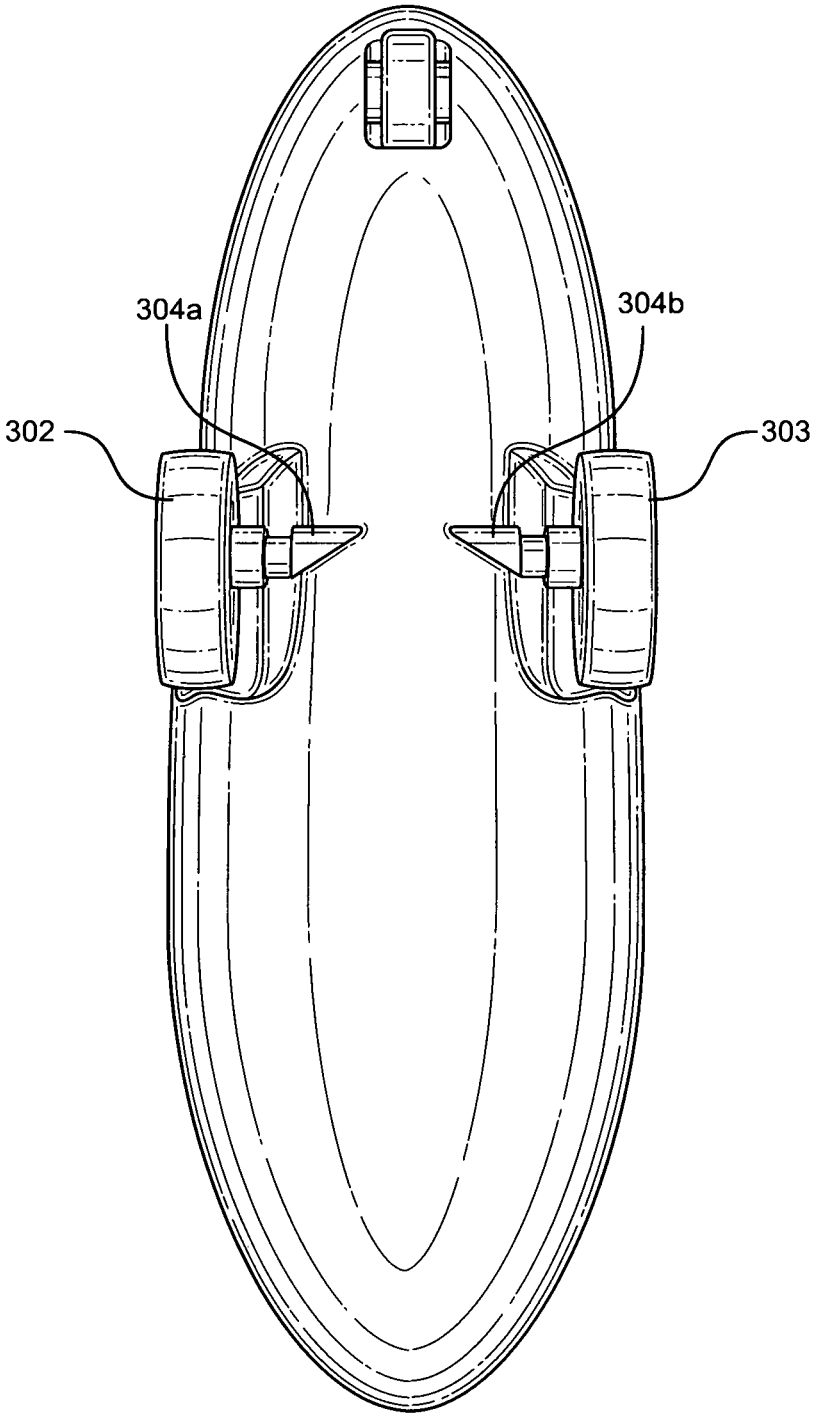
FIG. 31 is a bottom view of the fuselage base.
Figure 32:
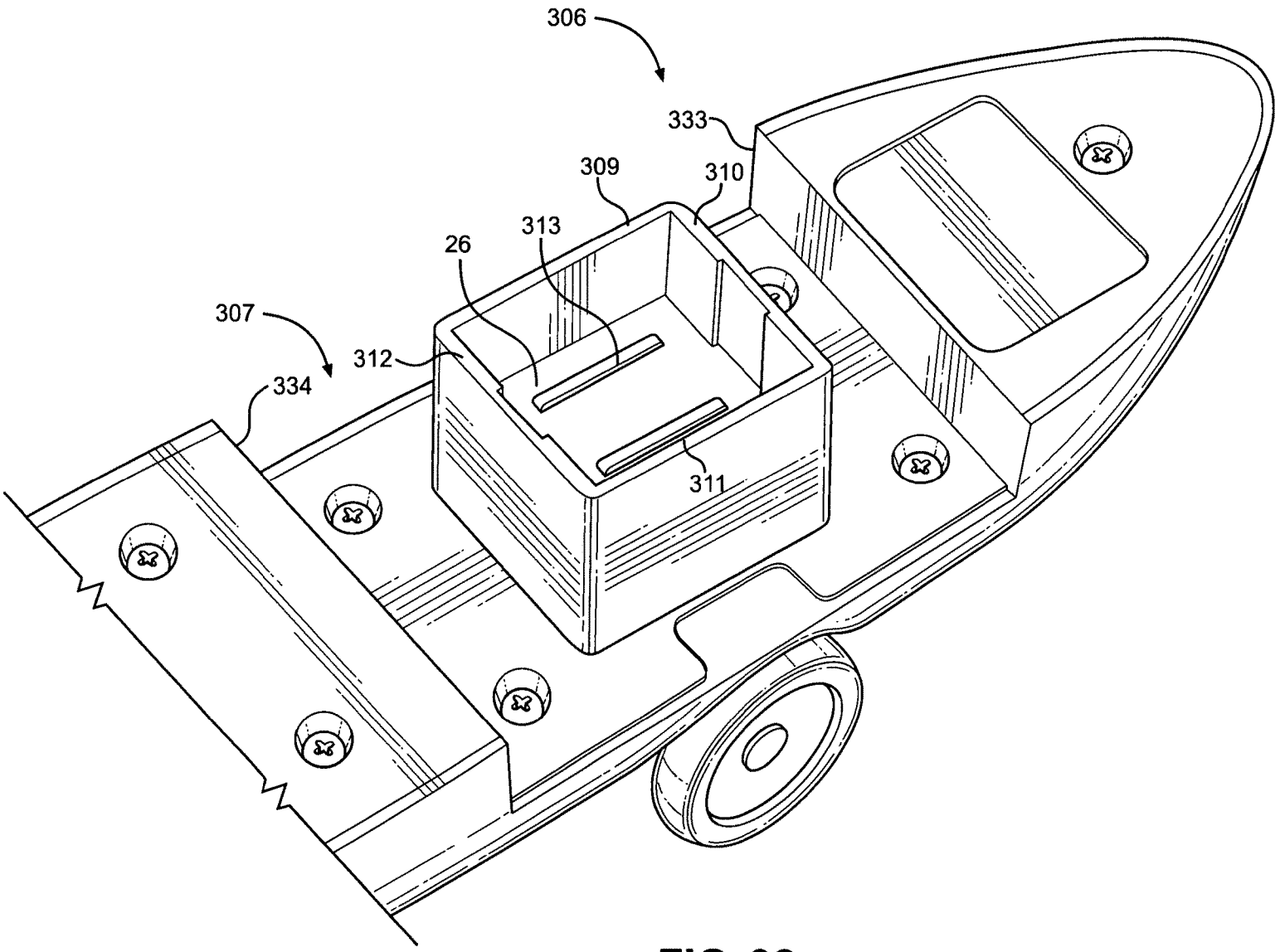
FIG. 32 is a top view of a closeup of one section of the fuselage base.
Figure 33:
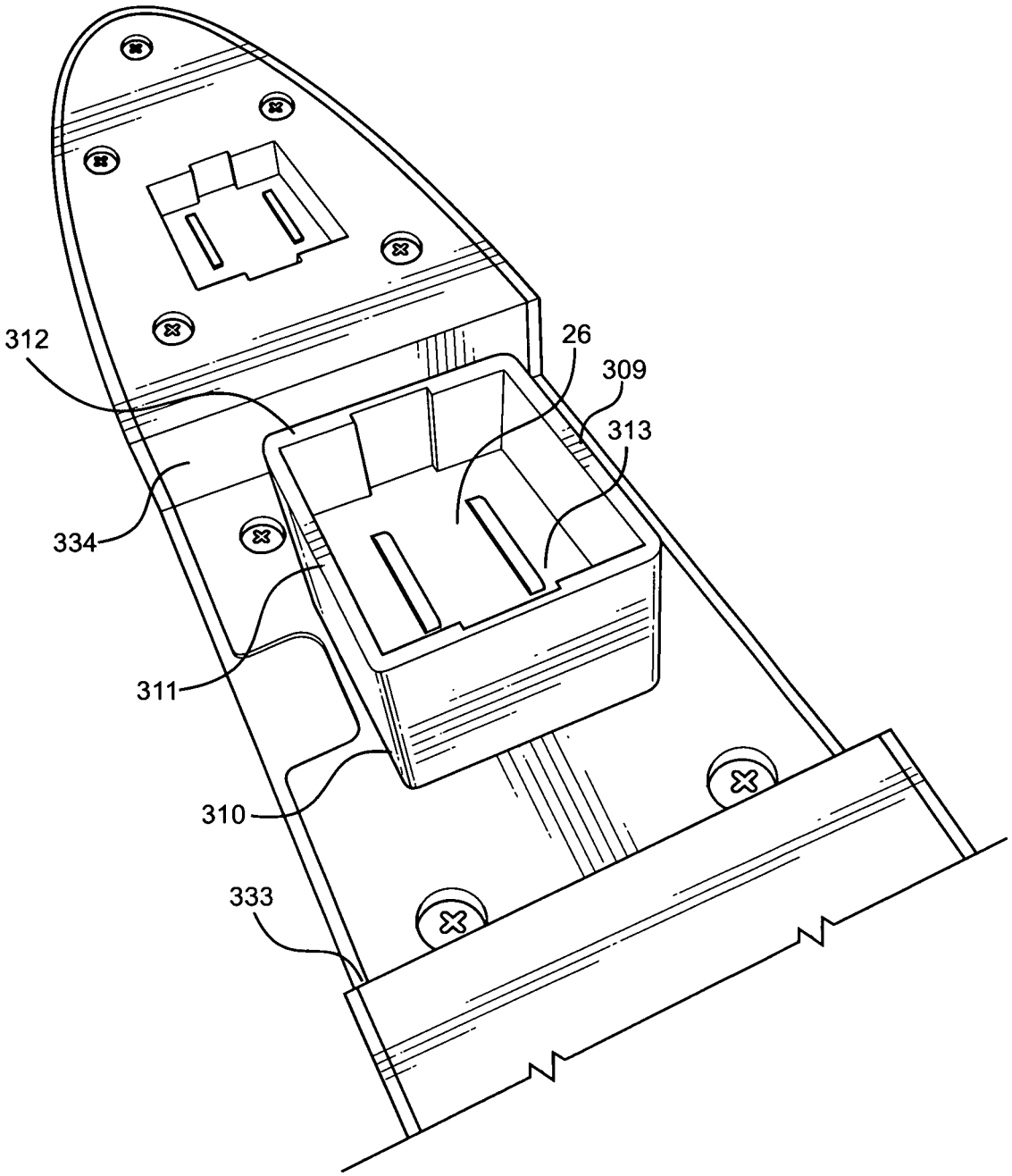
FIG. 33 is another top view of a closeup of one section of the fuselage base.
Figure 34:
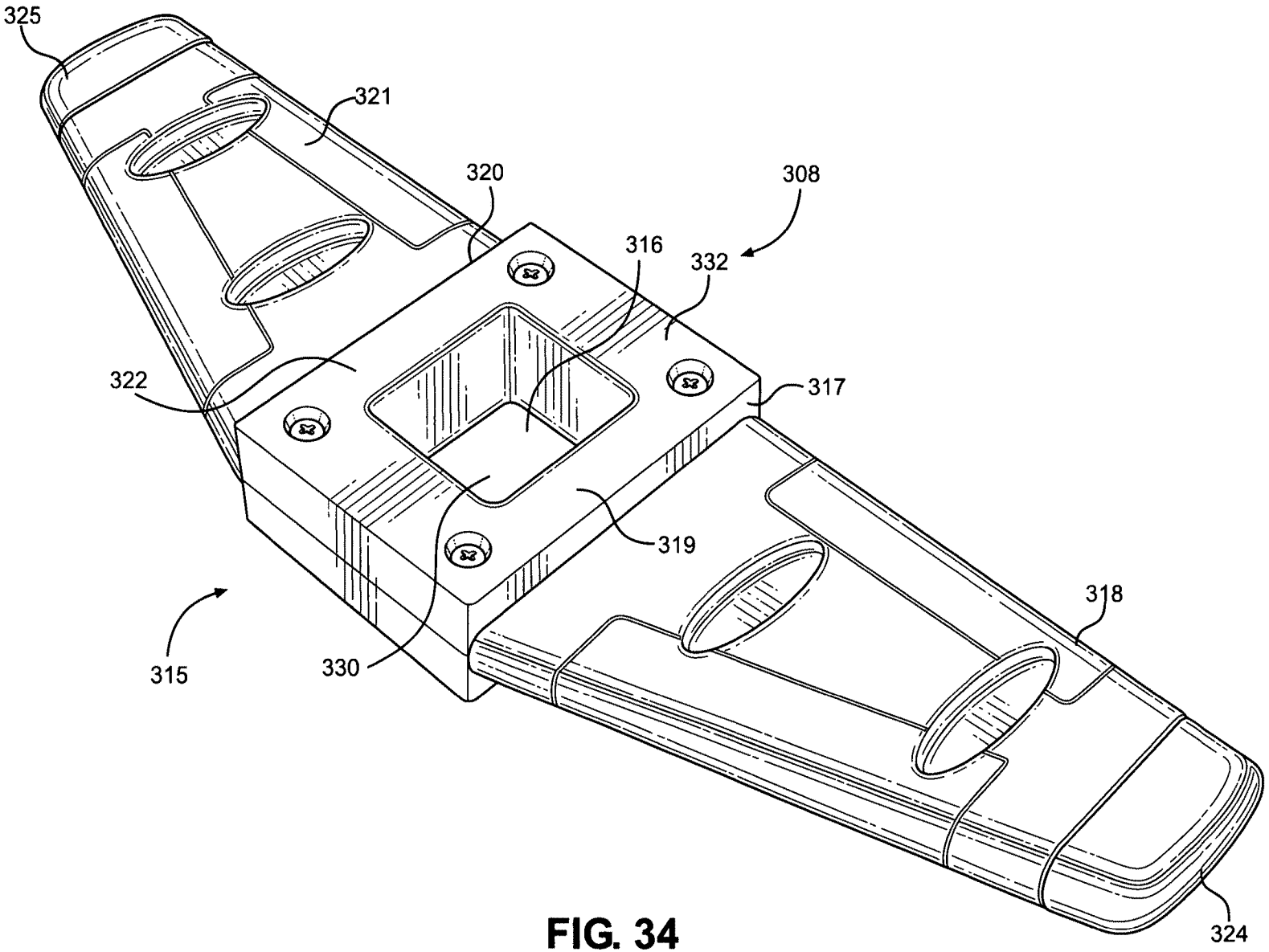
FIG. 34 is an overhead perspective view of the wingset.
Figure 35:
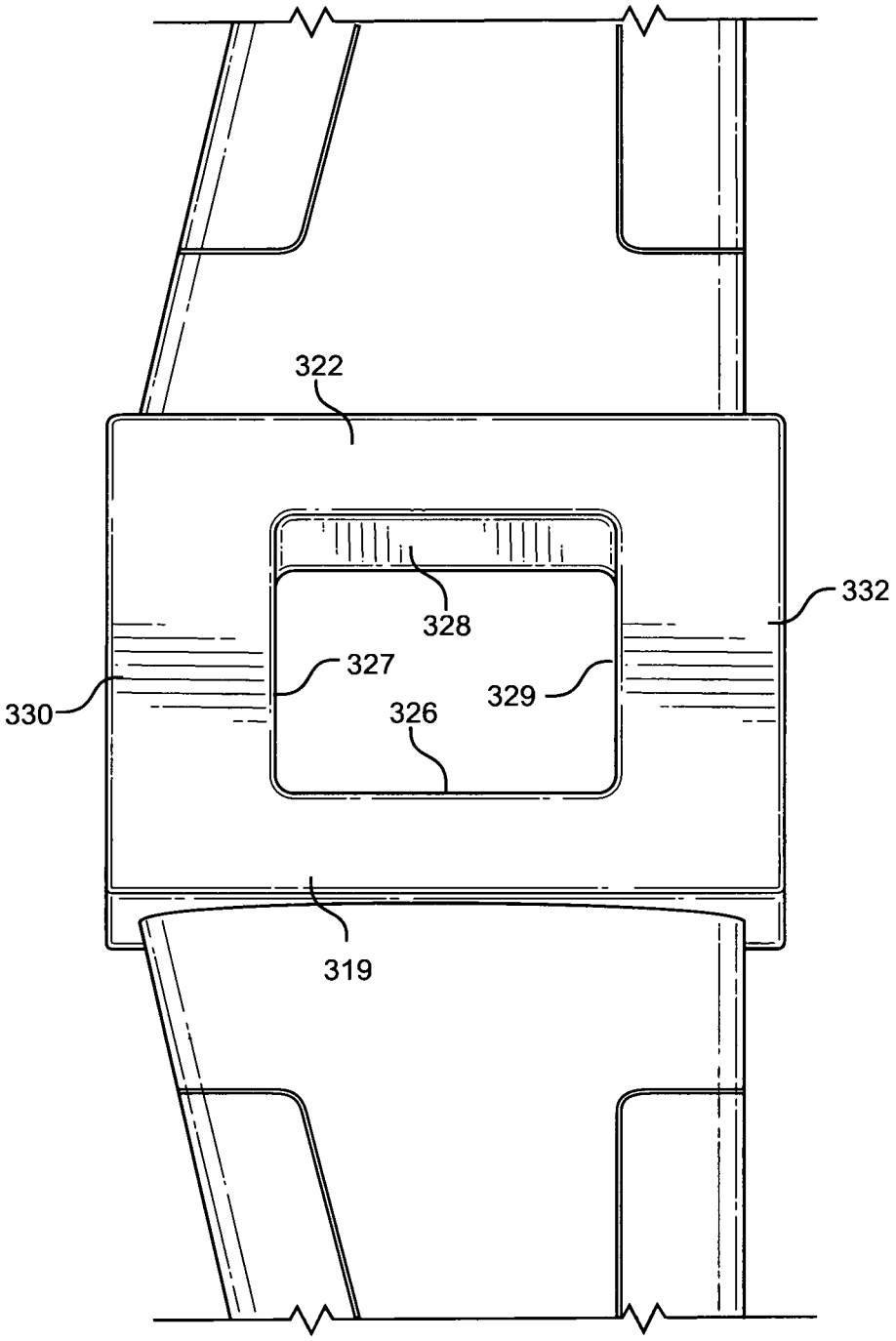
FIG. 35 is close-up of the center of the wingset.
Figure 36:
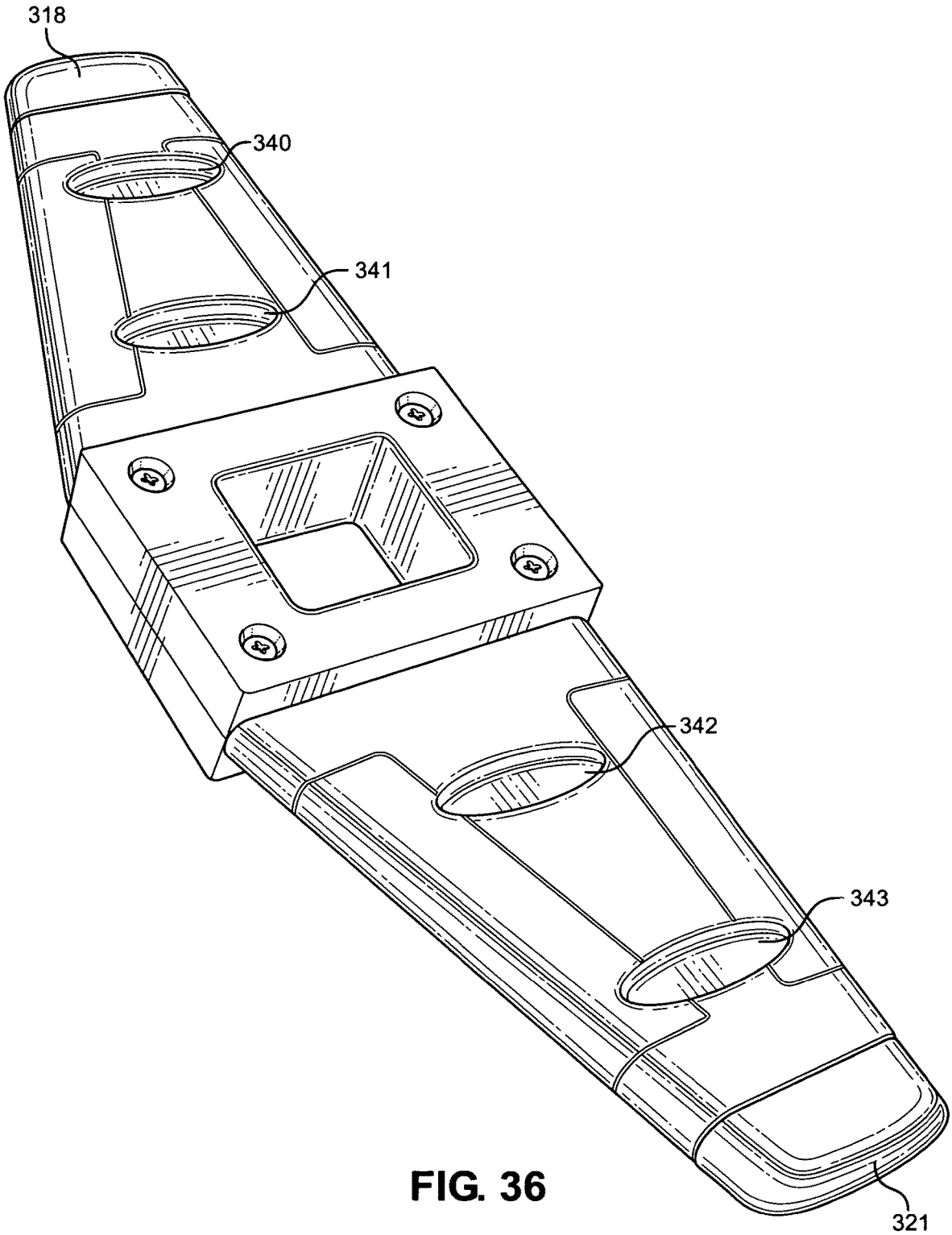
FIG. 36 is a perspective view of the underside of the wings.
Figure 37:
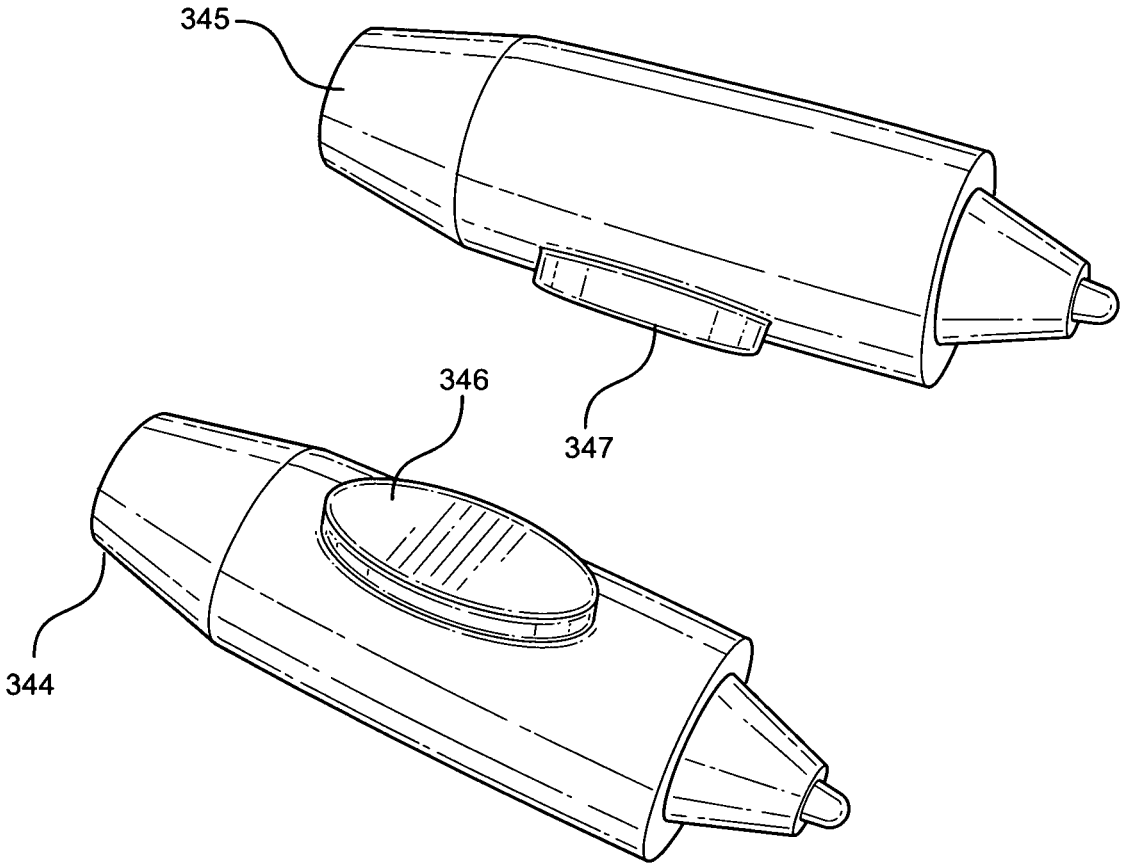
FIG. 37 is a perspective view of the toy jet engines.
Figure 38:
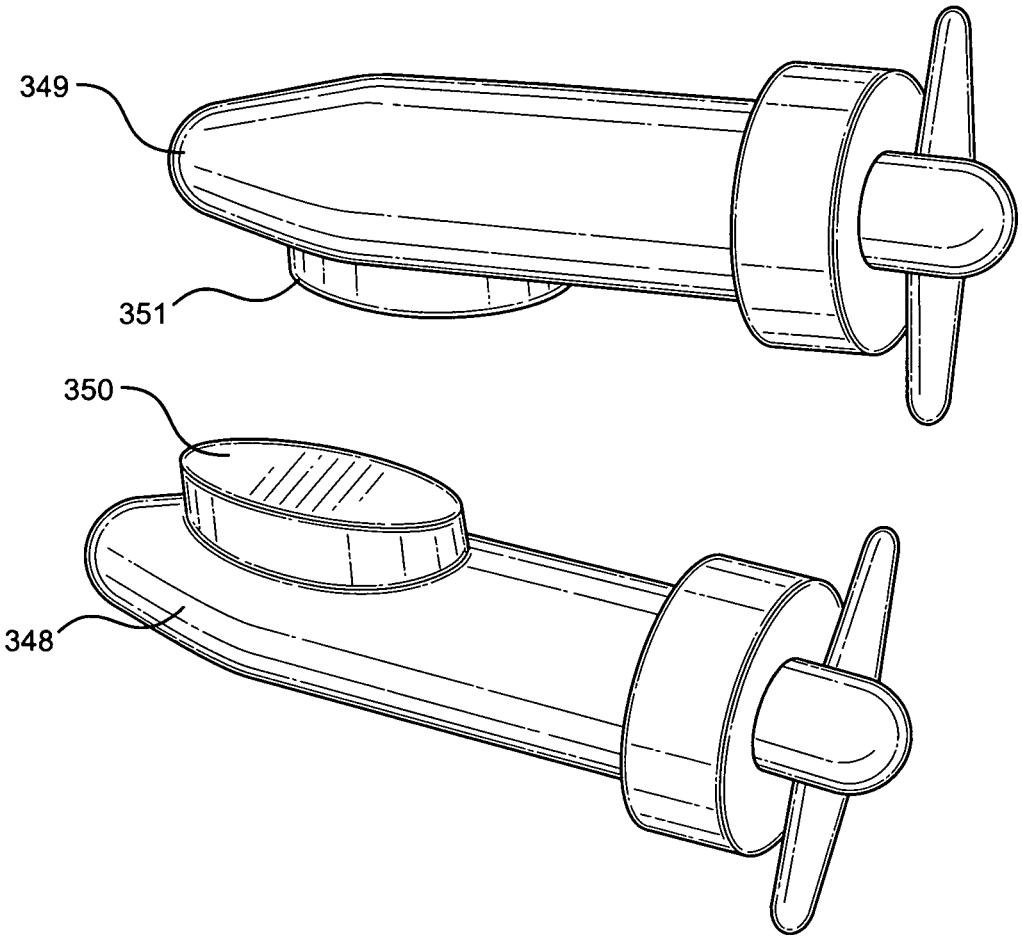
FIG. 38 is a perspective view of the propeller engines.
Figure 39:
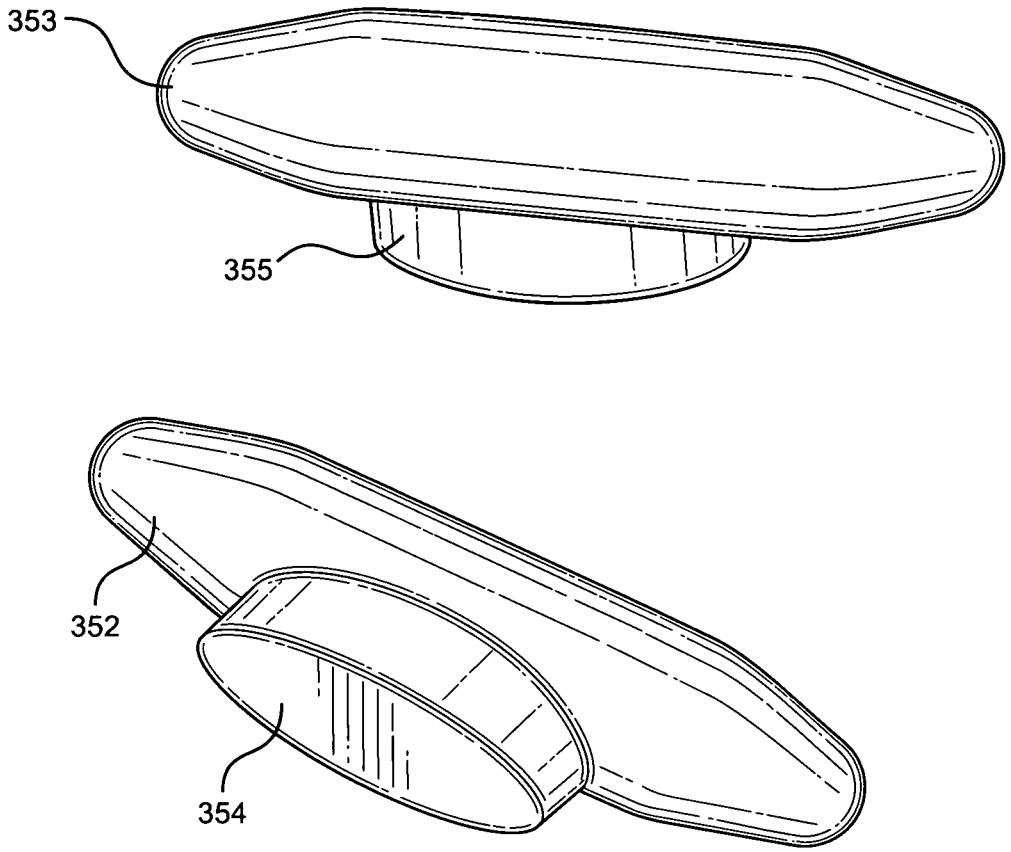
FIG. 39 is a perspective view of the fuel tanks.
Figure 40:
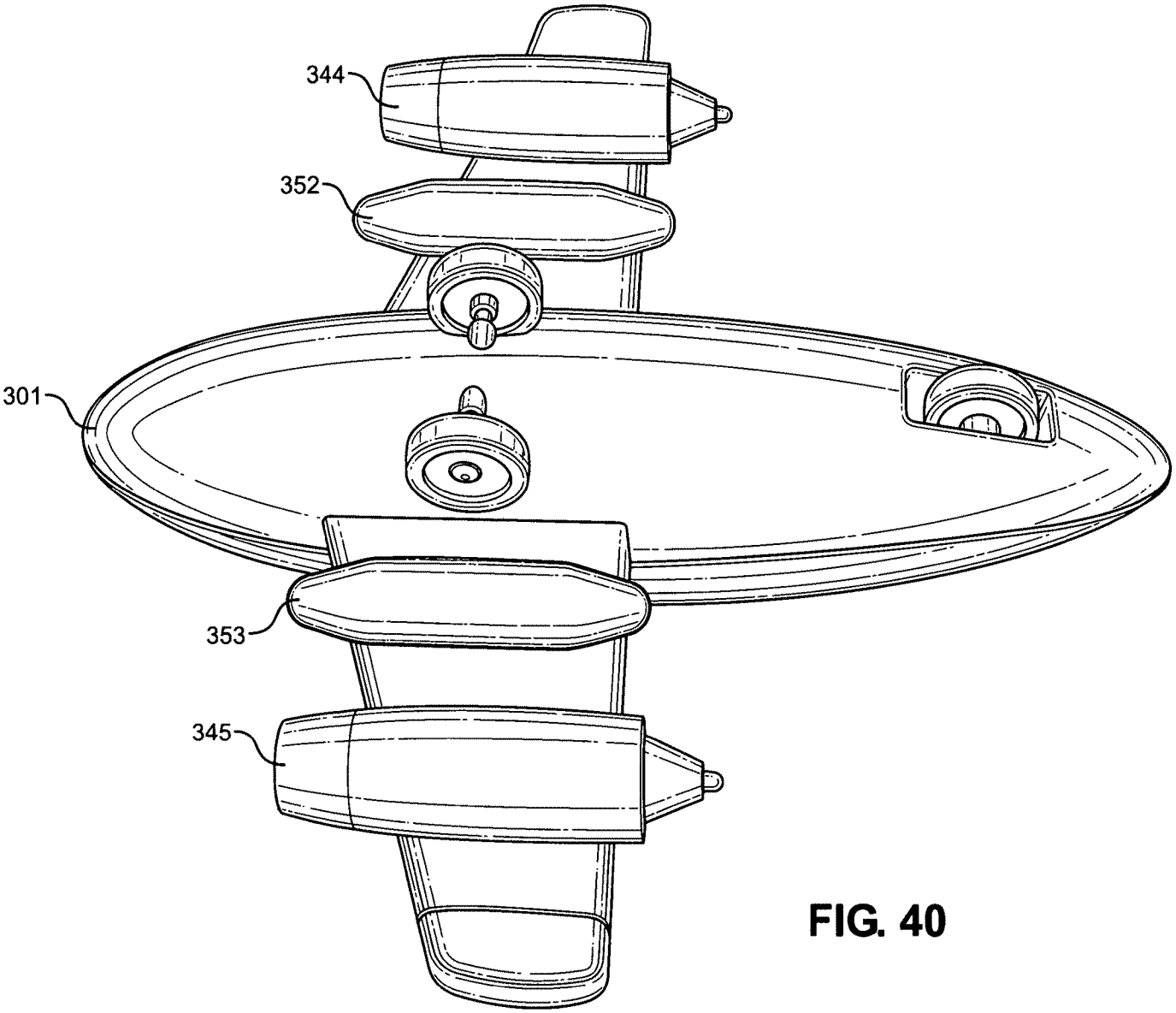
FIG. 40 is a bottom view of the underside of the toy airplane.
Figure 41:
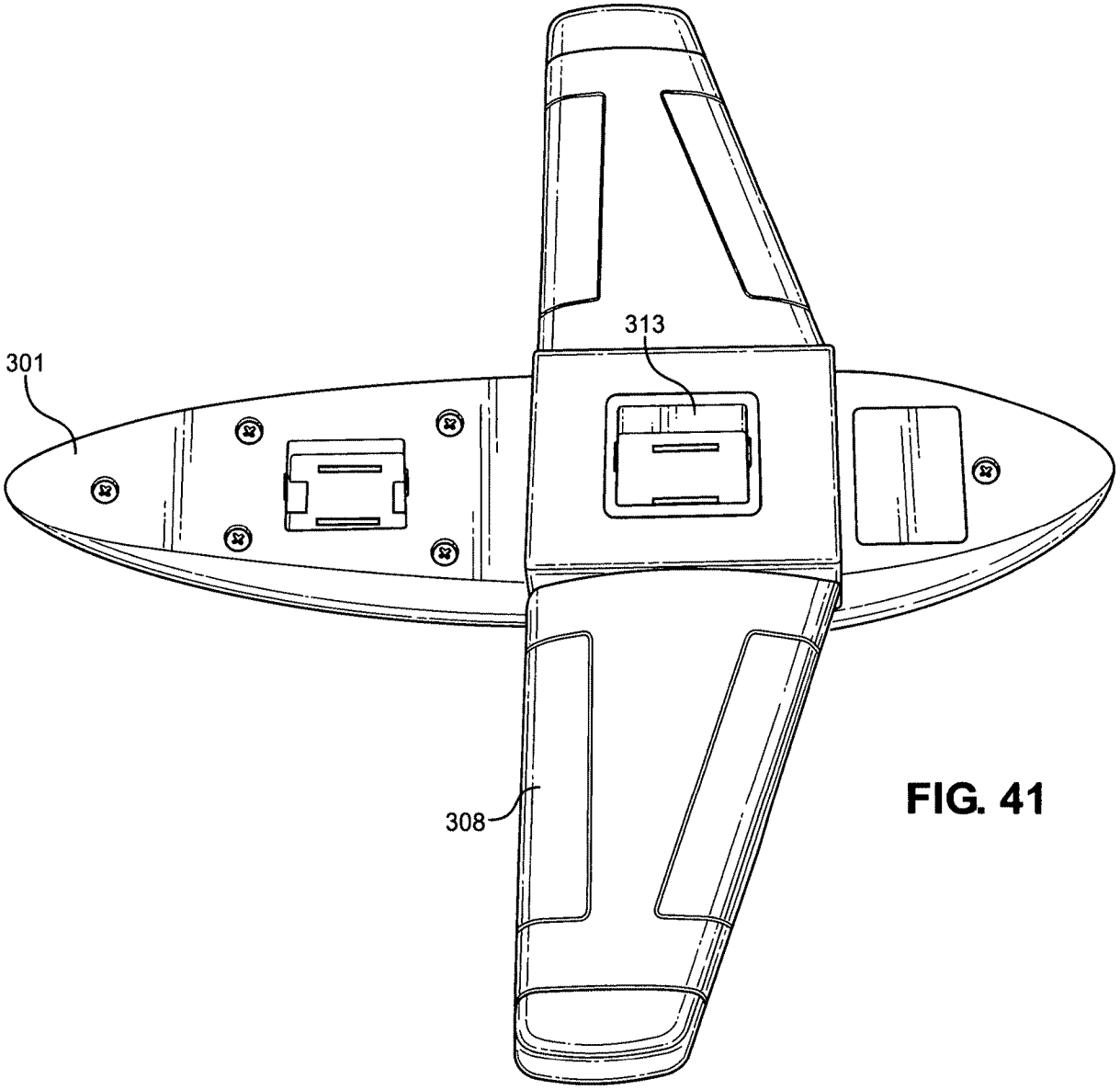
FIG. 41 is a perspective view of the wings attached to the bottom section of the fuselage.
Figure 42:
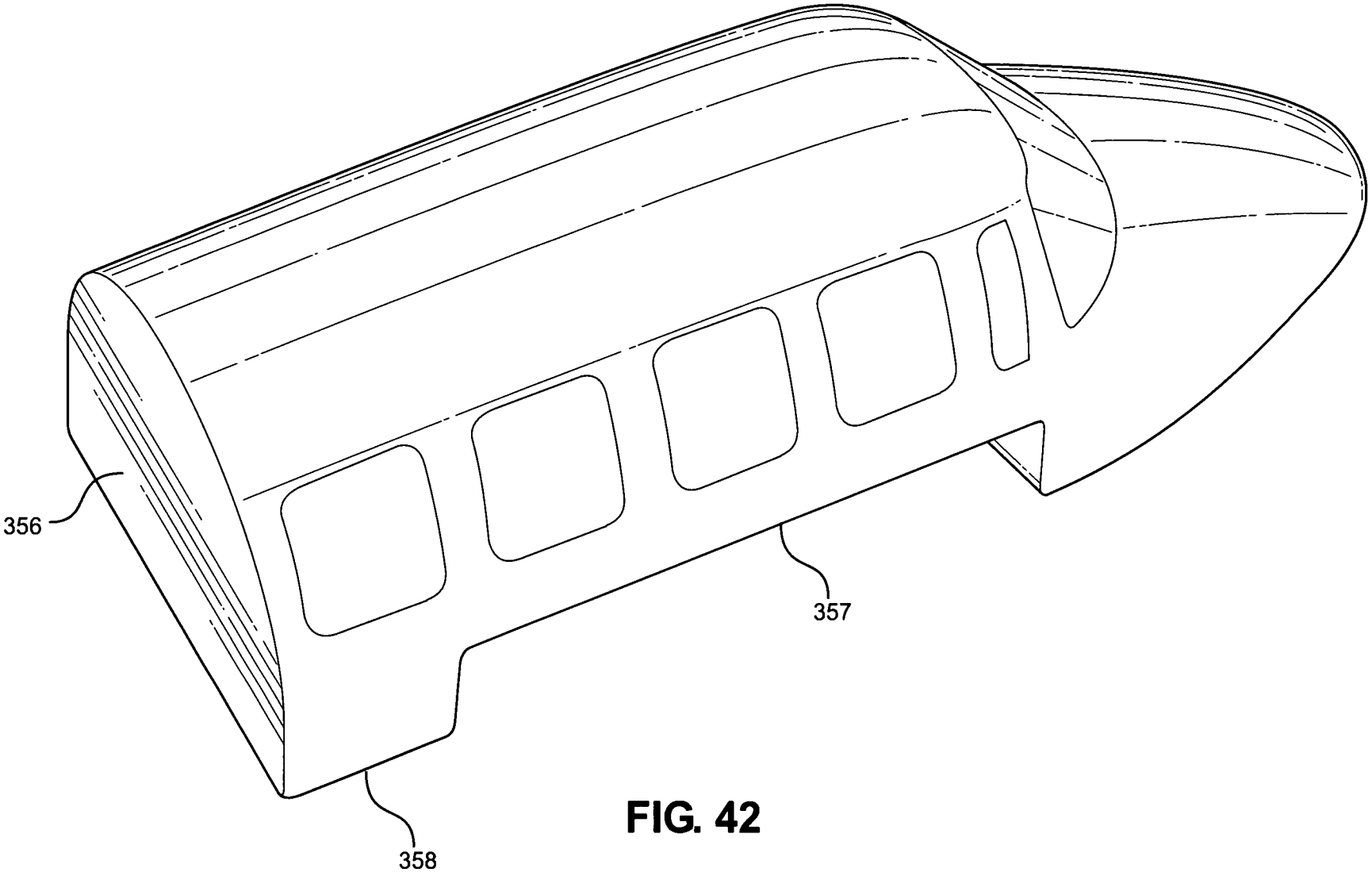
FIG. 42 is a perspective view of the upper front detachable section of the fuselage.
Figure 43:
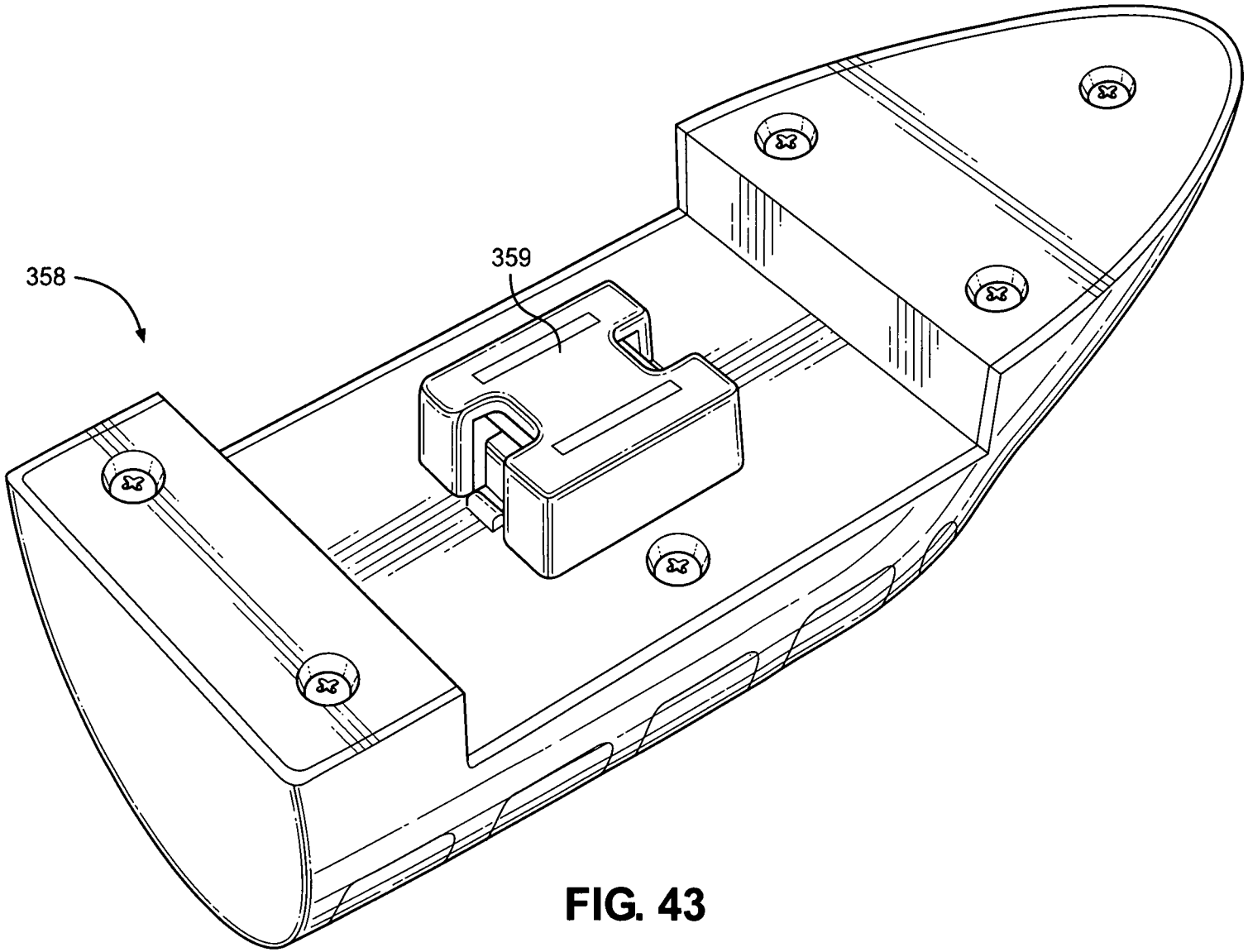
FIG. 43 is a bottom view of the upper front detachable section of the fuselage.
Figure 44:
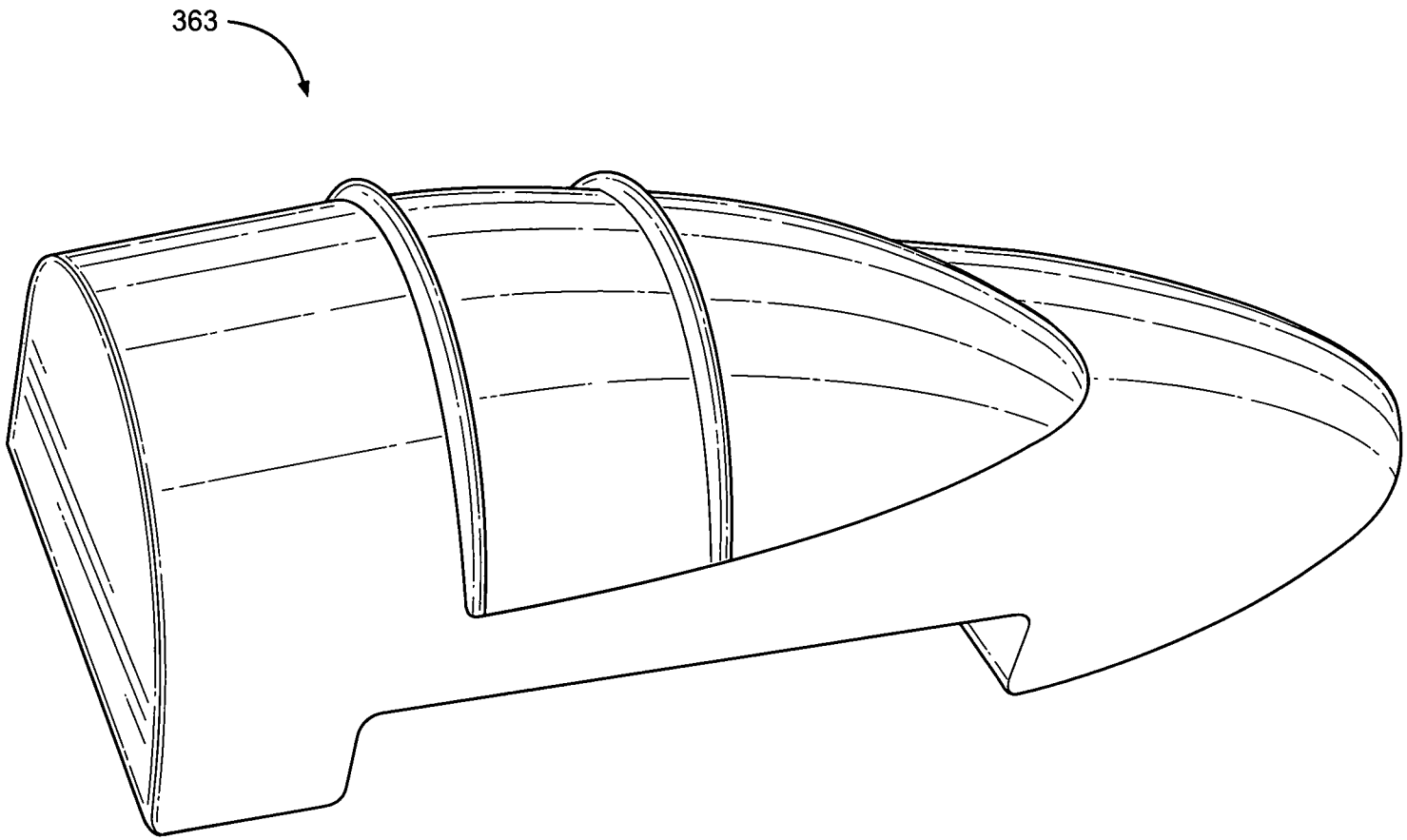
FIG. 44 is a perspective view of an alternative embodiment of the upper detachable section of the fuselage.
Figure 45:
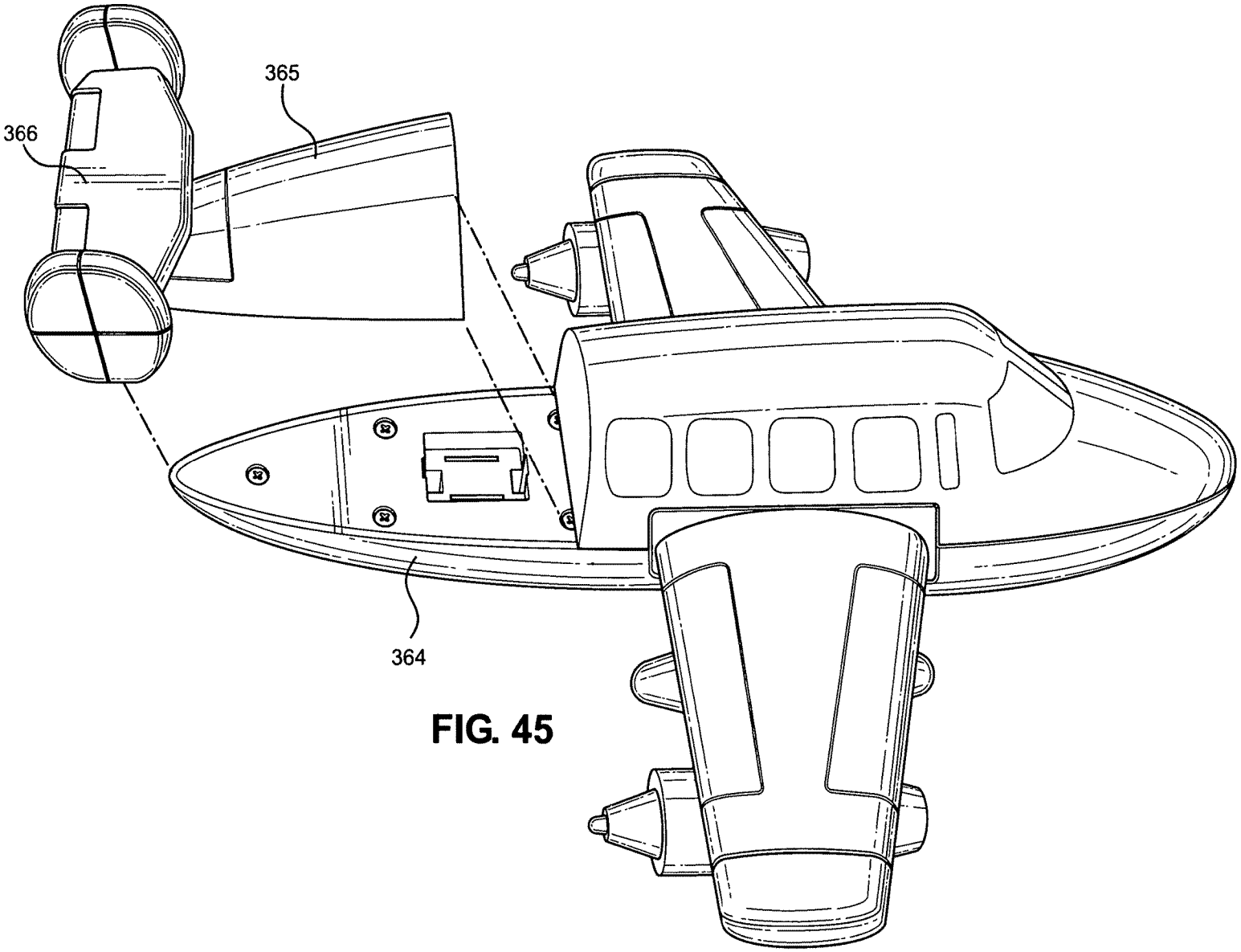
FIG. 45 is a perspective view of the attachment of an airplane tail to the back of the fuselage bottom.
Figure 46:
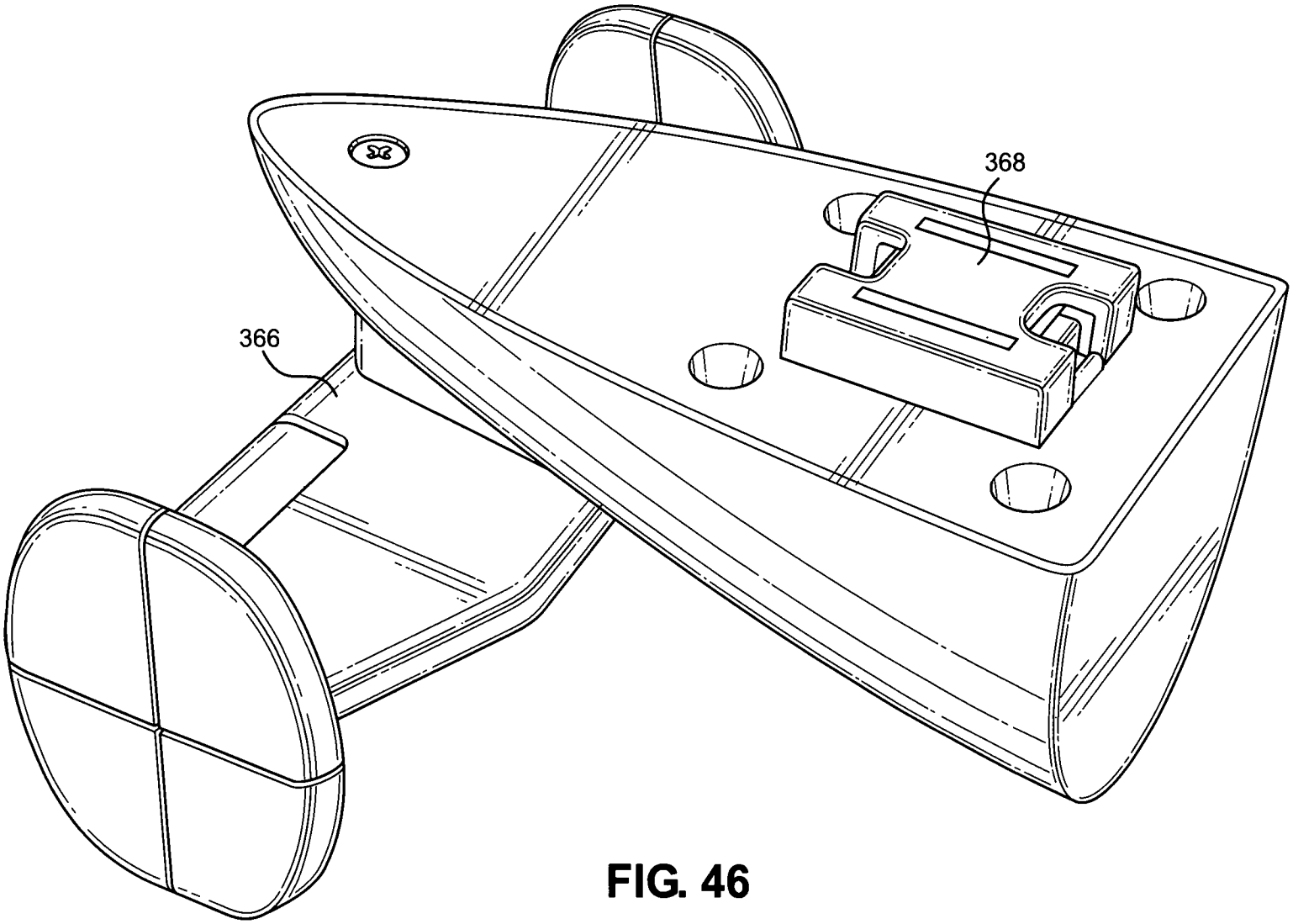
FIG. 46 is the bottom of the airplane tail of FIG. 45.
Figure 47:
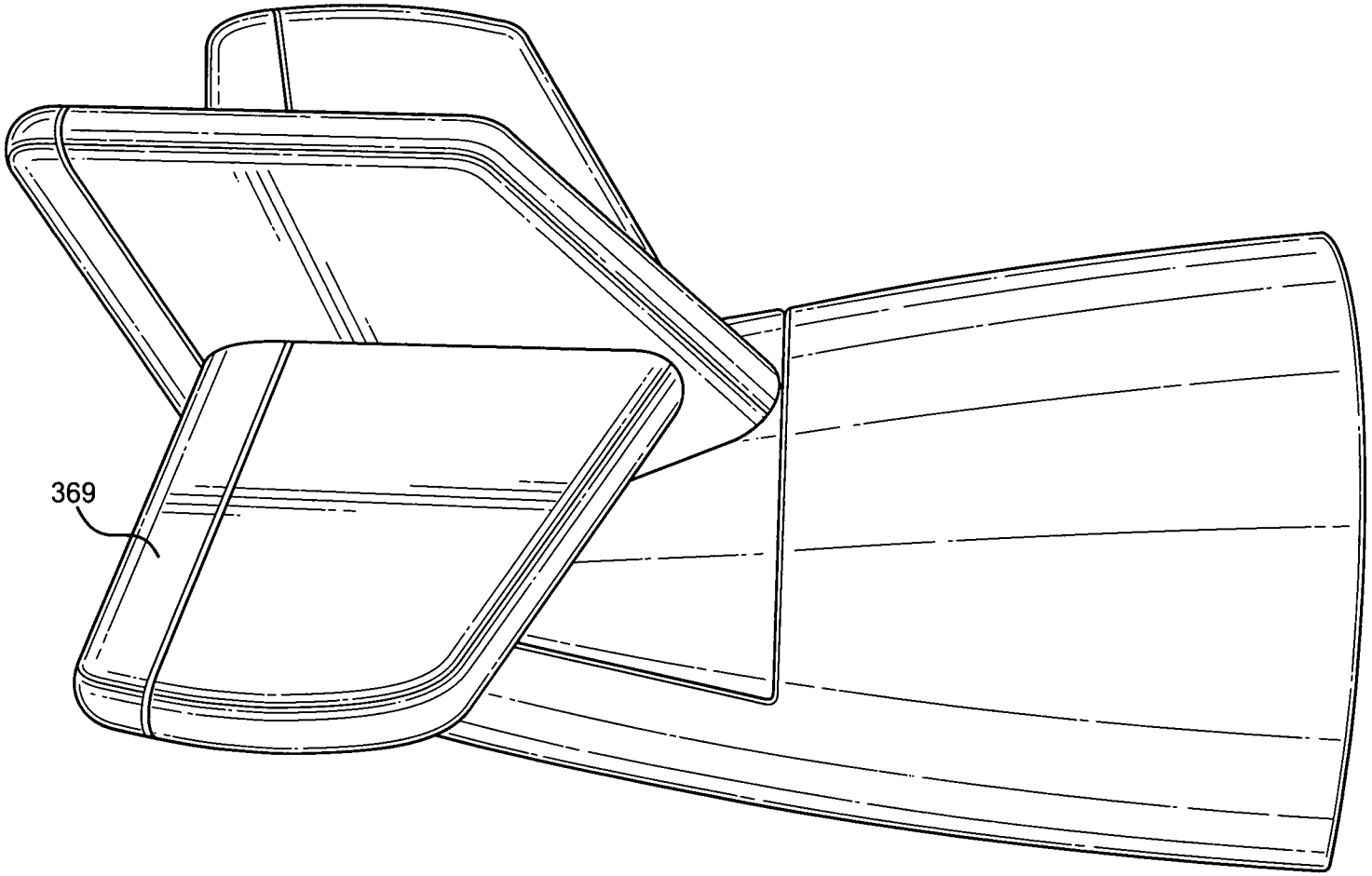
FIG. 47 is an alternative embodiment of the airplane tail.

Referring to FIGS. 1-2, and in one embodiment of the disclosure, the mix or match toy 1 includes an automobile unit 2, an airplane unit 3, a locomotive unit 4; and a boat unit 5. In other embodiments, any one of the transportation units are substituted for a bus unit (not shown) a space shuttle or any other mode of transportation. In another embodiment, there are additional transportation units. In another embodiment of the mix or match toy, the units have, instead of a transportation theme, a different theme. For example, the theme could be buildings, fashion, humans, fish, mammals or other animals (including insects, birds, etc), food, dinosaurs, botany, lab equipment, electronic devices, monsters, etc, and even combinations thereof.

Each unit is comprised of at least two sections. In one embodiment, each unit is comprised of at least three sections such that the automobile unit 2 comprises a front auto section 6, a second or middle auto section 7, and a rear auto section 8. Continuing the scenario, the airplane unit 3 comprises a front airplane section 9, a second or middle airplane section 10, and a rear airplane section 11. The locomotive unit 4 comprises a front locomotive section 12, a second or middle locomotive section 13, and a rear locomotive section 14. The boat unit 5 comprises a boat front section 15, a second or middle boat section 16, and a rear boat section 17.

The distal walls 18, 19, 20, 21 of front sections 6, 9, 12, 15, have female receptors 22, 23, 24, 25. The female receptors are shown as rectangular; however, in other embodiments, the female receptors are rectangular, oval, circular, triangular, pentagonal, or any other shape. Representative of all of the square female receptors, the automobile receptor has receptor side walls 200, 201, 202, 203 Within each of the female receptors 22, 23, 24, 25 there is at least one magnet which is either glued to the receptor rear wall 26, 27, 28, 29 of the female receptor 22, 23, 24, 25, or embedded into or within the plastic of the receptor rear wall 26, 27, 28, 29. In one embodiment, part of the magnet projects from the receptor rear wall 26, 27, 28, 29, magnet inserted through the front wall 26 from behind the front the wall 26. In one embodiment, two magnets either parallel, next to each other, or one on top of another, project from the front wall. In one embodiment, two magnets are positioned parallel and perpendicular to the length of the body of the structure, each of said magnets partially extending out from said receptor rear wall 26, 27, 28, 29.

In another embodiment, North and South poles 30 & 31; 32 & 33; 34 & 35; 36 & 37 comprising the two ends of the same magnet are projecting through the receptor end wall 26, 27, 28, 29, with the body of the magnet integral with the two poles positioned behind the front wall (not shown). The magnet is held in place by any method known in the art.

The rear ends or sections 8, 11, 14, 17 of each of the units have, at their proximal walls 38, 39, 40, 41, projections 42, 43, 44, 45, containing or a material 46, 47, 48, 49, which is attracted to a magnet. This material includes iron, nickel, cobalt, some alloys of rare earth metals, and some naturally occurring minerals such as lodestone. These materials while not magnets themselves, are ferromagnetic materials.

In one embodiment, the material is attached to the male projection by an adhesive (not shown). In another embodiment, the material is in the form of a plate 300, enveloped by the male projection 42, 43, 44, 45. The plate (herein labeled as the material 46, 47, 48, 49, positioned near the proximal walls 50, 51, 52, 53 of the male projection) of the male projection, is held in place by a cage 54,55,56,57, Again, using the automobile unit 2 as representative of the other units, within opposing indentations 400, 401 of the cage, and positioned at the top section 410 and bottom section 411 of cage 54 is clip 58 positioned in the same plane and opposite from clip 59. Clips 58, 59 are positioned on a base 60, and are positioned to push the ferromagnetic plate against proximal wall 50 having two parallel linear openings 62, 63 corresponding to the magnets of the female connector. The proximal wall 50 is integral with support columns 64, 65 for supporting the projection plate which has part of indentations 400, 401 for the clips.

Middle sections 7, 10, 13, 16 have a proximal end 66, 67, 68, 69, and a distal end 70, 71, 72, 73. As shown, the proximal ends have male projections 74, 75, 76, 77, and distal ends have female receptors 78, 79, 80, 81.

In another embodiment, the front sections 6, 9, 12, 15 comprise the male projection and the rear sections have the female receptors. Similarly, the position of the male projections and female receptors on the middle section can be reversed. In all cases, the shape of the female receptor corresponds to the shape of the male projection, and vice versa. The male or female receptors can be positioned through the walls prior to the walls being inserted into the various sections. These receptors can be snapped in, held in place by glue, or by any other means known in the art.

Each section of the individual units 2,3,4,5, have a top section 82, 83, 84, 85 and a bottom section 86, 87, 88, 89. The contour of the top sections 82, 83, 84, 85 are virtually identical to/with each other, and the contours of the bottom sections 86, 87, 88, 89 are virtually identical to/with each other. Thus, the various front, mid and end sections of the various embodiments are interchangeable. At least one mid-section of one vehicle can be interchanged with or added to another vehicle. Alternatively, a rear section can be interchanged. There are countless possibilities. The top sections and the bottom sections can be secured by any means known in the art, including glue, snapping together of a pin and hole, screwing the two sections together, etc.

The distal and proximal walls containing the projection and receptor are either inserted after the top and bottom sections are secured together or before. These walls can be glued into position snapped into position by pins, or by any other means known in the art. The walls are fitted within or at the ends of the contour.

The differences among the sections lies in the extensions extending from the sections, the features painted on the various sections of the vehicles, and the set of wheels on the front sections and rear sections of the vehicles. Also, non-contoured features that extend from the contour of the unit differ.

The automobile unit 2 has a hood 100 as part of the front section, painted on headlights 101, 101 a and a set of mag wheels 102 103 held in place by an axle 104 which in turn is held in place by a grab split 105 on the underside of the front section of the automobile unit 2. The front section also has two side view mirrors 106, 107. As in all of the units, the proximal and distal ends of the sections are glued in or secured in place by any known method. Prior to inserting the distal or proximate ends, the appropriate magnetic or metal inserts are positioned through the front wall of the female receptor or through an opening in the distal or positioned through proximal walls for the male receptor.

The front section also comprises two door handles 113, 114, as well as a painted on front windshield 115, and two side windows 116, 117.

The middle section of the automobile unit has painted on windows 118, 119, door handles 120, 121, and a moon roof 122. The rear section of the automobile unit has another set of wheels.

The end section of the automobile unit 2 comprises two side windows 128, 129, a rear window 130, and, besides some other accoutrements, a set of mag wheels 131, 132, held in place by an axle 133, along with the male projection discussed supra.

The locomotive unit which is the locomotive comprises a front section having a cow catcher 134, two sets of four wheels 135, 136, 137, 138 held by two axles (not shown). The front section has two horns 140, 141 above the control room 142.

A mix or match toy set is disclosed wherein four units having a common theme have at least two or three sections. These two or three sections can be interchanged with one another. In one embodiment the units are different transportation vehicles. The units are held together by using magnets in male and female connectors.

The middle section of the locomotive unit comprises air intake vents 143, 144 as well as vent 145 and two exhaust pipes 146, 147, and the end section of the locomotive unit comprises two air intake vents 148, 149, a fan ensemble 150, and a rear door (not shown), as well as two sets of locomotive wheels 152, 153, 154, 155, held by two axles (not shown).

The plane unit comprises a front section having a nose 156, pilots' windows 157, 158, and a set of wheels 159, 160 secured by means known in the art. The middle section of the plane unit has wings 161, 162 and painted on windows 163, 164, 165, 166, 167, 168. The rear section has a set of wheels 169, 170, horizontal stabilizers 171, 172 and vertical stabilizers 173, 174.

The boat unit has a front section having a rounded bow 175, a life preserver 176, and a set of wheels 177, 178. The middle section of the boat comprises a cabin superstructure and the rear section of the boat comprises the stem 179, with an open area 180 for passengers or fishermen as well as a set of wheels. There are other accoutrements extending from the rear section.

The various sections of the various transportation units can be interchanged. For example, a middle section for an automobile can be inserted in place of or in addition to the middle section for the airplane. In another example, the front section of the locomotive can be attached to the middle section of the boat, and the end section can be the end section from the airplane. There are numerous possibilities.

In another embodiment, a self contained toy unit comprises a toy airplane 300 which has an airplane bottom fuselage base 301 allowing for the connection of various fuselages and empennages. The fuselage base 301 comprises the bottom half of a fuselage. In one embodiment, there exists a front pair of wheels 302, 303, connected by an axle 304 through openings 304*a*, 304*b* and in another embodiment, an additional back wheel 305. The top section 306 of the fuselage base 301 has a rectangular recess section 307 into which an airplane wing set 308 fits. Centered in the recess section is a receptor rear wall 26. The receptor rear wall 26 is bordered by four walls 309, 310, 311 312 rising above the top section 306 of the fuselage base 301, forming a female receptor 313 on top of a raised platform 314, such that the receptor rear wall is not flush with the base 400 of the recess section As clarification, the four walls 309, 310, 311, 312 form a rectangle, although they could form any shape corresponding to the shape of the female receptor.

It should be noted that in an alternative embodiment, the receptor 313 is within the airplane fuselage base. 301.

The airplane wing set 308 has a rectangular center section 315 having a square opening 316 formed by the four walls 326, 327, 328, 329. The rectangular center section 315 has sides 319, 322, 330, 332. A first side 317 of a first wing 318 is connected to a first side wall 319 of the center section 315. A first side 320 of a second wing 321 is attached to a second side wall 322 of the center section 323. A second side of the first wing is a wing tip 324, and the second side of the second wing is a wing tip 325. The front wall 330 is positioned against wall 333 of the recess section 307 and the back wall 332 is positioned against the back wall 334 of the recess section 307.

In one embodiment, on the underside of each of the wings 318, 321, there are at least one, and in another embodiment at least two magnetic attachments or a plurality of matching attachments or mounts 340, 341, 342, 343 on the underside of each wing. In one embodiment, these mounts are indented and have a common shape. In another embodiment, the mount is not indented or it projects from the undersigned with the wing. In yet another embodiment, the mount extends downward.

In one embodiment of the airplane kit, a plurality of parts are included in the kit for connection with the mounts. In one embodiment, there is at least one, and at least two plastic (or metal) toy jets 344, 345 having a magnetic attachment that fits within the indented mount under the wing. The jets 344, 345 would also fit on any form of the magnetic mount 340, 341, 342, 343. There could be a plurality of jets. The jets, as well as the plane, could also be made out of wood. Each of the plurality of jets has a receiver 346, 347 which in one embodiment contains a ferromagnetic material which attaches to the mount on the airplane.

In another embodiment, there are at least one or at least two or even a plurality of plastic (or metal) propellers engines 348, 349 that have a ferromagnetic attachment 350, 351 that can or will mate with any of the mounts.

Similarly, there can be either alone or in addition to the jet and/or propeller engines two additional fuel tanks 352,353 that have a ferromagnetic attachment 354, 355 that can or will mate with any of the mounts.

There can be any combination of jets, propeller engines and fuel tanks. It should further be noted that the airplane wing set 308 can be turned upside down so that the mounts are on top of the wing.

In yet another embodiment, the attachment between the underside of the wing and the various jet engines, propeller motors, and fuel tanks can be by snaps, clips, or any other interchangeable means of attachment.

In another embodiment, the part of the front top section of the toy airplane comprising what would be the fuselage top front 356 comprising a cutout section 357 on the underside 358 of the fuselage front 356. The underside cutout section 357 corresponds with or complements and fits over the rectangular center section 315 of the wing set 308. The center of the underside cutout section has extending downward a male projection or connector 359. This male projection or connector 359 fits within female connector 313 described above in the airplane. It should be noted that the contour of the fuselage front 356 matches the contour of both the center section 315 of the airplane wing set 308 and the contour of the airplane bottom fuselage base 301.

Similarly, the contour of the center section 315 matches the contour of the fuselage front 356 and the bottom fuselage base 301.

In one embodiment, the civilian front top fuselage section 356 is interchangeable with a military style front top fuselage section 363 or any other style front top fuselage that will fit. In another embodiment, there are interchangeable fuselages with other sections. There can also be interchangeable airplane wings, as long as the connecting features and the fit remain the same. This applies to all interchangeable parts.

In another embodiment, the rear section of the bottom fuselage base 301 has a female receptor 364 within the bottom fuselage base. This female receptor in one embodiment has a lower depth than other female receptors, and in another embodiment, a normal depth, either of which is fine as long as the male connector matches the adjusted depth by an appropriate and similar height. A civilian rear section 365 supporting a tail 366 of a plane has a flat underside 367, extending from which is a male connector 368 that fits within the female receptor 364. In another embodiment a military style rear section 369 is interchangeable with the with the civilian style rear section 366. There are many possibilities for different designs and styles of the plane, including different rear sections.

It will be apparent to those skilled in the art that various modifications and variations can be made to the disclosure described above without departing from the spirit or scope of the disclosure. Thus, it is intended that the present disclosure cover modifications and variations that come within the scope of the appended claims and their equivalents.

What is claimed is:

1. A toy airplane comprising:

a) a bottom fuselage base comprising a top section having a rectangular recessed section;

b) a first female receptor connector, said first female receptor connector centered in the rectangular recessed section and surrounded by and integral with four walls, said first female receptor connector comprising:

1) a top side female receptor connector wall;
2) a bottom side female receptor connector wall;
3) a first side female receptor connector wall;
4) a second side female receptor connector wall; and
5) a rear female receptor connector wall;
6) ferromagnetic metal in communication within and retained by said rear female receptor connector wall;

a shape of said first female receptor connector being complementary to a shape of a first male connector such that said first male connector is capable of fitting within said first female receptor connector, and a ferromagnetic plate of said first male connector being attracted to said ferromagnetic metal of said first female receptor connector, wherein said first male connector comprises:

aa) a top male connector wall, a middle of said top male connector wall interrupted by a first clip extending from an end wall;

bb) a bottom male connector wall, a middle of said bottom male connector wall interrupted by a second clip extending from said end wall;

cc) a first side male connector wall;

dd) a second side male connector wall;

ee) a front male connector wall;

the ferromagnetic plate of said first male connector being positioned behind and in contact with said front male connector wall, said ferromagnetic plate of said first male connector held in place by said first clip and said second clip pushing said ferromagnetic plate against a rear section of said front male connector wall;

c) a removable wing set, said removable wing set having a rectangular center section having a centered opening that fits around the four integral walls of the first female receptor connector; and d) an interchangeable fuselage front top, said fuselage front top comprising:

a) a cutout section to fit over the rectangular center section of the removable wing set; and b) said first male connector having the ability to fit into said first female receptor connector, said fuselage front top having the same contour as the bottom fuselage base.

2. The toy airplane of claim 1, further comprising:

a) a second female receptor connector, said second female receptor connector positioned in a rear section of the bottom fuselage base; and b) an interchangeable tail section having a second male connector positioned on the underside of said interchangeable tail section.

3. The toy airplane of claim 2, further comprising a plurality of attachments containing a ferromagnetic structure complementary to said plurality of magnetic mounts, said plurality of attachments selected from the group consisting of jet motors, propeller motors, fuel tanks, and combinations thereof.

4. The toy airplane of claim 1, further comprising a plurality of magnetic mounts on an underside of the wing set.

* * * * *